US011642564B2

(12) United States Patent
Watterson

(10) Patent No.: US 11,642,564 B2
(45) Date of Patent: May 9, 2023

(54) EXERCISE MACHINE

(71) Applicant: iFIT Inc., Logan, UT (US)

(72) Inventor: Scott R. Watterson, Logan, UT (US)

(73) Assignee: iFIT Inc., Logan, UT (US)

( * ) Notice: Subject to any disclaimer, the term of this patent is extended or adjusted under 35 U.S.C. 154(b) by 0 days.

(21) Appl. No.: 17/450,679

(22) Filed: Oct. 12, 2021

(65) Prior Publication Data

US 2022/0023702 A1 Jan. 27, 2022

Related U.S. Application Data

(63) Continuation of application No. 16/780,765, filed on Feb. 3, 2020, now Pat. No. 11,298,577.
(Continued)

(51) Int. Cl.
*A63B 21/075* (2006.01)
*A63B 21/00* (2006.01)
(Continued)

(52) U.S. Cl.
CPC ..... *A63B 21/075* (2013.01); *A63B 21/005* (2013.01); *A63B 21/0058* (2013.01);
(Continued)

(58) Field of Classification Search
CPC ..... A63B 21/075; A63B 21/00181; A63B 21/0058; A63B 21/023; A63B 21/072;
(Continued)

(56) References Cited

U.S. PATENT DOCUMENTS 3,123,646 A 3/1964 Easton
3,467,377 A * 9/1969 Harbaugh ..... A63B 63/083 473/482
(Continued)

FOREIGN PATENT DOCUMENTS

CN 109890467 A 6/2019
CN 111601646 A 8/2020
(Continued)

OTHER PUBLICATIONS

Chinese Second Office Action dated Apr. 8, 2022 in Chinese Patent Application No. 202080013335.0.
(Continued)

*Primary Examiner* — Loan B Jimenez
*Assistant Examiner* — Kathleen M Fisk
(74) *Attorney, Agent, or Firm* — Ray Quinney & Nebeker P.C.; Paul N. Taylor

(57) ABSTRACT

An exercise machine may include a frame, a resistance mechanism supported by the frame, first and second pull cables supported by the frame and linked to the resistance mechanism, a power rack attached to the frame, first and second handles selectively attachable to the first and second pull cable, and first and second pulleys. The power rack includes upright posts configured to have barbell holders adjustably attached thereto such that the barbell holders are configured to be adjusted in various positions between highest positions and lowest positions on the upright posts. The pulleys are configured to selectively receive the pull cables to enable the pull cables to be selectively attached to a barbell to assist or hinder a user in lifting the barbell in a combined cable and free weight workout, the pull cables decoupled from the pulleys for cable workouts.

20 Claims, 11 Drawing Sheets

Related U.S. Application Data

(60) Provisional application No. 62/804,146, filed on Feb. 11, 2019.

(51) Int. Cl.

| | |
|---|---|
| ***A63B 21/078*** | (2006.01) |
| ***A63B 21/072*** | (2006.01) |
| ***A63B 21/02*** | (2006.01) |
| ***A63B 24/00*** | (2006.01) |
| ***A63B 71/06*** | (2006.01) |
| ***A63B 21/22*** | (2006.01) |
| ***A63B 21/005*** | (2006.01) |
| *A63B 23/04* | (2006.01) |

(52) U.S. Cl.

CPC ..... *A63B 21/00181* (2013.01); *A63B 21/023* (2013.01); *A63B 21/072* (2013.01); *A63B 21/0724* (2013.01); *A63B 21/0783* (2015.10); *A63B 21/153* (2013.01); *A63B 21/154* (2013.01); *A63B 21/156* (2013.01); *A63B 21/225* (2013.01); *A63B 24/0075* (2013.01); *A63B 24/0087* (2013.01); *A63B 71/0622* (2013.01); *A63B 2023/0411* (2013.01); *A63B 2071/0625* (2013.01); *A63B 2208/0223* (2013.01); *A63B 2225/74* (2020.08)

(58) Field of Classification Search

CPC ..... A63B 21/0724; A63B 21/07283; A63B 21/153; A63B 21/154; A63B 21/156; A63B 21/225; A63B 21/00192; A63B 21/4035; A63B 24/0075; A63B 24/0087; A63B 71/0622; A63B 71/0036; A63B 71/023; A63B 23/0405; A63B 23/1236; A63B 2023/0411; A63B 2071/0625; A63B 2071/0072; A63B 2071/065; A63B 2071/068; A63B 2071/0694; A63B 2208/0223; A63B 2208/0252; A63B 2208/0204; A63B 2208/0233; A63B 2225/74; A63B 2225/20; A63B 2225/50; A63B 2225/685; A63B 2024/0068; A63B 2024/0093; A63B 2209/10; A63B 2220/20; A63B 2220/54; A63B 2220/80; A63B 2220/803; A63B 2220/805; A63B 2220/806; A63B 2220/833; A63B 2230/06; A63B 2230/40; A63B 2230/75; A63B 21/00058–00065; A63B 21/005–0059; A63B 21/15–156; A63B 21/22–227; A63B 21/4033

See application file for complete search history.

(56) References Cited

U.S. PATENT DOCUMENTS

| | | | | |
|---|---|---|---|---|
| 3,579,339 | A | 5/1971 | Chang et al. | |
| 4,023,795 | A | 5/1977 | Pauls | |
| 4,300,760 | A | 11/1981 | Bobroff | |
| D286,311 | S | 10/1986 | Martinell et al. | |
| 4,681,318 | A | 7/1987 | Lay | |
| 4,684,126 | A | 8/1987 | Dalebout et al. | |
| 4,728,102 | A | 3/1988 | Pauls | |
| 4,750,736 | A | 6/1988 | Watterson | |
| 4,796,881 | A | 1/1989 | Watterson | |
| 4,813,667 | A | 3/1989 | Watterson | |
| 4,844,451 | A | 7/1989 | Bersonnet et al. | |
| 4,850,585 | A | 7/1989 | Dalebout | |
| 4,856,773 | A * | 8/1989 | Deola | A63B 21/0626 482/102 |
| D304,849 | S | 11/1989 | Watterson | |
| 4,880,225 | A | 11/1989 | Lucas et al. | |
| 4,883,272 | A | 11/1989 | Lay | |
| D306,468 | S | 3/1990 | Watterson | |
| D306,891 | S | 3/1990 | Watterson | |
| 4,913,396 | A | 4/1990 | Dalebout et al. | |
| D307,614 | S | 5/1990 | Bingham et al. | |
| D307,615 | S | 5/1990 | Bingham et al. | |
| 4,921,242 | A | 5/1990 | Watterson | |
| 4,932,650 | A | 6/1990 | Bingham et al. | |
| D309,167 | S | 7/1990 | Griffin | |
| D309,485 | S | 7/1990 | Bingham et al. | |
| 4,938,478 | A | 7/1990 | Lay | |
| D310,253 | S | 8/1990 | Bersonnet et al. | |
| 4,955,599 | A | 9/1990 | Bersonnet et al. | |
| 4,971,316 | A | 11/1990 | Dalebout et al. | |
| D313,055 | S | 12/1990 | Watterson | |
| 4,974,832 | A | 12/1990 | Dalebout | |
| 4,979,737 | A | 12/1990 | Kock | |
| 4,981,294 | A | 1/1991 | Dalebout et al. | |
| D315,765 | S | 3/1991 | Measom et al. | |
| 4,998,725 | A | 3/1991 | Watterson et al. | |
| 5,000,442 | A | 3/1991 | Dalebout et al. | |
| 5,000,443 | A | 3/1991 | Dalebout et al. | |
| 5,000,444 | A | 3/1991 | Dalebout et al. | |
| D316,124 | S | 4/1991 | Dalebout et al. | |
| 5,013,033 | A | 5/1991 | Watterson et al. | |
| 5,014,980 | A | 5/1991 | Bersonnet et al. | |
| 5,016,871 | A | 5/1991 | Dalebout et al. | |
| D318,085 | S | 7/1991 | Jacobson et al. | |
| D318,086 | S | 7/1991 | Bingham et al. | |
| D318,699 | S | 7/1991 | Jacobson et al. | |
| 5,029,801 | A | 7/1991 | Dalebout et al. | |
| 5,034,576 | A | 7/1991 | Dalebout et al. | |
| 5,058,881 | A | 10/1991 | Measom | |
| 5,058,882 | A | 10/1991 | Dalebout et al. | |
| D321,388 | S | 11/1991 | Dalebout | |
| 5,062,626 | A | 11/1991 | Dalebout et al. | |
| 5,062,627 | A | 11/1991 | Bingham | |
| 5,062,632 | A | 11/1991 | Dalebout et al. | |
| 5,062,633 | A | 11/1991 | Engel et al. | |
| 5,067,710 | A | 11/1991 | Watterson et al. | |
| 5,072,929 | A | 12/1991 | Peterson et al. | |
| D323,009 | S | 1/1992 | Dalebout et al. | |
| D323,198 | S | 1/1992 | Dalebout et al. | |
| D323,199 | S | 1/1992 | Dalebout et al. | |
| D323,863 | S | 2/1992 | Watterson | |
| 5,088,729 | A | 2/1992 | Dalebout | |
| 5,090,694 | A | 2/1992 | Pauls et al. | |
| 5,102,380 | A | 4/1992 | Jacobson et al. | |
| 5,104,120 | A | 4/1992 | Watterson et al. | |
| 5,108,093 | A | 4/1992 | Watterson | |
| D326,491 | S | 5/1992 | Dalebout | |
| 5,122,105 | A | 6/1992 | Engel et al. | |
| 5,135,216 | A | 8/1992 | Bingham et al. | |
| 5,147,265 | A | 9/1992 | Pauls et al. | |
| 5,149,084 | A | 9/1992 | Dalebout et al. | |
| 5,149,312 | A | 9/1992 | Croft et al. | |
| 5,171,196 | A | 12/1992 | Lynch | |
| D332,347 | S | 1/1993 | Raadt et al. | |
| 5,190,505 | A | 3/1993 | Dalebout et al. | |
| 5,192,255 | A | 3/1993 | Dalebout et al. | |
| 5,195,937 | A | 3/1993 | Engel et al. | |
| 5,203,826 | A | 4/1993 | Dalebout | |
| D335,511 | S | 5/1993 | Engel et al. | |
| D335,905 | S | 5/1993 | Cutter et al. | |
| D336,498 | S | 6/1993 | Engel et al. | |
| 5,217,487 | A | 6/1993 | Engel et al. | |
| D337,361 | S | 7/1993 | Engel et al. | |
| D337,666 | S | 7/1993 | Peterson et al. | |
| D337,799 | S | 7/1993 | Cutter et al. | |
| 5,226,866 | A | 7/1993 | Engel et al. | |
| 5,244,446 | A | 9/1993 | Engel et al. | |
| 5,247,853 | A | 9/1993 | Dalebout | |
| 5,259,611 | A | 11/1993 | Dalebout et al. | |
| D342,106 | S | 12/1993 | Campbell et al. | |
| 5,279,528 | A | 1/1994 | Dalebout et al. | |
| D344,112 | S | 2/1994 | Smith | |
| D344,557 | S | 2/1994 | Ashby | |
| 5,282,776 | A | 2/1994 | Dalebout | |
| 5,295,931 | A | 3/1994 | Dreibelbis et al. | |

(56) References Cited

U.S. PATENT DOCUMENTS 5,302,161 A 4/1994 Loubert et al.
D347,251 S 5/1994 Dreibelbis et al.
5,316,534 A 5/1994 Dalebout et al.
D348,493 S 7/1994 Ashby
D348,494 S 7/1994 Ashby
5,328,164 A 7/1994 Soga
D349,931 S 8/1994 Bostic et al.
5,336,142 A 8/1994 Dalebout et al.
5,344,376 A 9/1994 Bostic et al.
D351,202 S 10/1994 Bingham
D351,435 S 10/1994 Peterson et al.
D351,633 S 10/1994 Bingham
D352,534 S 11/1994 Dreibelbis et al.
D353,422 S 12/1994 Bostic et al.
5,372,559 A 12/1994 Dalebout et al.
5,374,228 A 12/1994 Buisman et al.
5,382,221 A 1/1995 Hsu et al.
5,387,168 A 2/1995 Bostic
5,393,690 A 2/1995 Fu et al.
D356,128 S 3/1995 Smith et al.
5,409,435 A 4/1995 Daniels
5,429,563 A 7/1995 Engel et al.
5,431,612 A 7/1995 Holden
D360,915 S 8/1995 Bostic et al.
5,468,205 A 11/1995 McFall et al.
5,489,249 A 2/1996 Brewer et al.
5,492,517 A 2/1996 Bostic et al.
D367,689 S 3/1996 Wilkinson et al.
5,511,740 A 4/1996 Loubert et al.
5,512,025 A 4/1996 Dalebout et al.
D370,949 S 6/1996 Furner
D371,176 S 6/1996 Furner
5,527,245 A 6/1996 Dalebout et al.
5,529,553 A 6/1996 Finlayson
5,540,429 A 7/1996 Dalebout et al.
5,549,533 A 8/1996 Olson et al.
5,554,085 A 9/1996 Dalebout
5,569,128 A 10/1996 Dalebout
5,591,105 A 1/1997 Dalebout et al.
5,591,106 A 1/1997 Dalebout et al.
5,595,556 A 1/1997 Dalebout et al.
5,607,375 A 3/1997 Dalebout et al.
5,611,539 A 3/1997 Watterson et al.
5,622,527 A 4/1997 Watterson et al.
5,626,538 A 5/1997 Dalebout et al.
5,626,542 A 5/1997 Dalebout et al.
D380,024 S 6/1997 Novak et al.
5,637,059 A 6/1997 Dalebout
D380,509 S 7/1997 Wilkinson et al.
5,643,153 A 7/1997 Nylen et al.
5,645,509 A 7/1997 Brewer et al.
D384,118 S 9/1997 Deblauw
5,662,557 A 9/1997 Watterson et al.
5,669,857 A 9/1997 Watterson et al.
5,672,140 A 9/1997 Watterson et al.
5,674,156 A 10/1997 Watterson et al.
5,674,453 A 10/1997 Watterson et al.
5,676,624 A 10/1997 Watterson et al.
5,683,331 A 11/1997 Dalebout
5,683,332 A 11/1997 Watterson et al.
D387,825 S 12/1997 Fleck et al.
5,695,433 A 12/1997 Buisman
5,695,434 A 12/1997 Dalebout et al.
5,695,435 A 12/1997 Dalebout et al.
5,702,325 A 12/1997 Watterson et al.
5,704,879 A 1/1998 Watterson et al.
5,718,657 A 2/1998 Dalebout et al.
5,720,200 A 2/1998 Anderson et al.
5,720,698 A 2/1998 Dalebout et al.
D392,006 S 3/1998 Dalebout et al.
5,722,922 A 3/1998 Watterson et al.
5,733,229 A 3/1998 Dalebout et al.
5,738,611 A * 4/1998 Ehrenfried ..... A63B 21/157
482/7
5,743,833 A 4/1998 Watterson et al.
5,762,584 A 6/1998 Daniels
5,762,587 A 6/1998 Dalebout et al.
5,772,560 A 6/1998 Watterson et al.
5,810,698 A 9/1998 Hullett et al.
5,827,155 A 10/1998 Jensen et al.
5,830,114 A 11/1998 Halfen et al.
5,860,893 A 1/1999 Watterson et al.
5,860,894 A 1/1999 Dalebout et al.
5,899,834 A 5/1999 Dalebout et al.
D412,953 S 8/1999 Armstrong
D413,948 S 9/1999 Dalebout
5,951,441 A 9/1999 Dalebout et al.
5,951,448 A 9/1999 Bolland
D416,596 S 11/1999 Armstrong
6,003,166 A 12/1999 Hald et al.
6,019,710 A 2/2000 Dalebout et al.
6,027,429 A 2/2000 Daniels
6,033,347 A 3/2000 Dalebout et al.
D425,940 S 5/2000 Halfen et al.
6,059,692 A 5/2000 Hickman
D428,949 S 8/2000 Simonson
6,123,646 A 9/2000 Colassi
6,171,217 B1 1/2001 Cutler
6,171,219 B1 1/2001 Simonson
6,174,267 B1 1/2001 Dalebout et al.
6,193,631 B1 2/2001 Hickman
6,228,003 B1 5/2001 Hald et al.
6,238,323 B1 5/2001 Simonson
6,251,052 B1 6/2001 Simonson
6,261,022 B1 7/2001 Dalebout et al.
6,280,362 B1 8/2001 Dalebout et al.
6,296,594 B1 10/2001 Simonson
D450,872 S 11/2001 Dalebout et al.
6,312,363 B1 11/2001 Watterson et al.
D452,338 S 12/2001 Dalebout et al.
D453,543 S 2/2002 Cutler
D453,948 S 2/2002 Cutler
6,350,218 B1 2/2002 Dalebout et al.
6,387,020 B1 5/2002 Simonson
6,413,191 B1 7/2002 Harris et al.
6,422,980 B1 7/2002 Simonson
6,447,424 B1 9/2002 Ashby et al.
6,458,060 B1 10/2002 Watterson et al.
6,458,061 B2 10/2002 Simonson
6,471,622 B1 10/2002 Hammer et al.
6,563,225 B2 5/2003 Soga et al.
6,601,016 B1 7/2003 Brown et al.
6,623,140 B2 9/2003 Watterson et al.
6,626,799 B2 9/2003 Watterson
6,652,424 B2 11/2003 Dalebout
6,685,607 B1 2/2004 Olson
6,695,581 B2 2/2004 Wasson et al.
6,701,271 B2 3/2004 Willner et al.
6,702,719 B1 3/2004 Brown et al.
6,712,740 B2 3/2004 Simonson
6,730,002 B2 5/2004 Hald et al.
6,743,153 B2 6/2004 Watterson et al.
6,746,371 B1 6/2004 Brown et al.
6,749,537 B1 6/2004 Hickman
6,761,667 B1 7/2004 Cutler et al.
6,770,015 B2 8/2004 Simonson
6,786,852 B2 9/2004 Watterson et al.
6,808,472 B1 10/2004 Hickman
6,821,230 B2 11/2004 Dalebout et al.
6,830,540 B2 12/2004 Watterson et al.
6,863,641 B1 3/2005 Brown et al.
6,866,613 B1 3/2005 Brown et al.
6,875,160 B2 4/2005 Watterson et al.
D507,311 S 7/2005 Butler et al.
6,918,858 B2 7/2005 Watterson
6,921,351 B1 7/2005 Hickman et al.
6,974,404 B1 12/2005 Watterson et al.
6,997,852 B2 2/2006 Watterson et al.
7,025,713 B2 4/2006 Dalebout et al.
D520,085 S 5/2006 Willardson et al.
7,044,897 B2 5/2006 Myers et al.
7,052,442 B2 5/2006 Watterson et al.
7,060,006 B1 6/2006 Watterson et al.
7,060,008 B2 6/2006 Watterson et al.

(56) References Cited

U.S. PATENT DOCUMENTS 7,070,539 B2 7/2006 Brown et al.
7,097,588 B2 8/2006 Watterson et al.
D527,776 S 9/2006 Willardson et al.
7,112,168 B2 9/2006 Dalebout et al.
7,128,693 B2 10/2006 Brown et al.
7,166,062 B1 1/2007 Watterson et al.
7,166,064 B2 1/2007 Watterson et al.
7,169,087 B2 1/2007 Ercanbrack et al.
7,169,093 B2 1/2007 Simonson et al.
7,192,388 B2 3/2007 Dalebout et al.
7,250,022 B2 7/2007 Dalebout et al.
7,282,016 B2 10/2007 Simonson
7,285,075 B2 10/2007 Cutler et al.
7,344,481 B2 3/2008 Watterson et al.
7,377,882 B2 5/2008 Watterson et al.
7,425,188 B2 9/2008 Ercanbrack et al.
7,429,236 B2 9/2008 Dalebout et al.
7,455,622 B2 11/2008 Watterson et al.
7,482,050 B2 1/2009 Olson
D588,655 S 3/2009 Utykanski
7,510,509 B2 3/2009 Hickman
7,537,546 B2 5/2009 Watterson et al.
7,537,549 B2 5/2009 Nelson et al.
7,537,552 B2 5/2009 Dalebout et al.
7,540,828 B2 6/2009 Watterson et al.
7,549,947 B2 6/2009 Hickman et al.
7,553,262 B2 * 6/2009 Piane, Jr. ..... A63B 23/12 482/99
7,556,590 B2 7/2009 Watterson et al.
7,563,203 B2 7/2009 Dalebout et al.
7,575,536 B1 8/2009 Hickman
7,601,105 B1 10/2009 Gipson et al.
7,604,573 B2 10/2009 Dalebout et al.
D604,373 S 11/2009 Dalebout et al.
7,618,350 B2 11/2009 Dalebout et al.
7,618,357 B2 11/2009 Dalebout et al.
7,625,315 B2 12/2009 Hickman
7,625,321 B2 12/2009 Simonson et al.
7,628,730 B1 12/2009 Watterson et al.
7,628,737 B2 12/2009 Kowallis et al.
7,637,847 B1 12/2009 Hickman
7,645,212 B2 1/2010 Ashby et al.
7,645,213 B2 1/2010 Watterson et al.
7,658,698 B2 2/2010 Pacheco et al.
7,674,205 B2 3/2010 Dalebout et al.
7,713,171 B1 5/2010 Hickman
7,713,172 B2 5/2010 Watterson et al.
7,713,180 B2 5/2010 Wickens et al.
7,717,828 B2 5/2010 Simonson et al.
7,736,279 B2 6/2010 Dalebout et al.
7,740,563 B2 6/2010 Dalebout et al.
7,749,144 B2 7/2010 Hammer
7,766,797 B2 8/2010 Dalebout et al.
7,771,329 B2 8/2010 Dalebout
7,775,940 B2 8/2010 Dalebout et al.
7,789,800 B1 9/2010 Watterson et al.
7,798,946 B2 9/2010 Dalebout et al.
7,815,550 B2 10/2010 Watterson et al.
7,857,731 B2 12/2010 Hickman et al.
7,862,475 B2 1/2011 Watterson et al.
7,862,478 B2 1/2011 Watterson et al.
7,862,483 B2 1/2011 Hendrickson et al.
D635,207 S 3/2011 Dalebout et al.
7,901,330 B2 3/2011 Dalebout et al.
7,909,740 B2 3/2011 Dalebout et al.
7,967,728 B2 6/2011 Zavadsky et al.
7,980,996 B2 7/2011 Hickman
7,981,000 B2 7/2011 Watterson et al.
7,985,164 B2 7/2011 Ashby
7,988,604 B2 * 8/2011 Barnett ..... A63B 71/0054 482/99
7,988,605 B1 * 8/2011 Wyeroski ..... A63B 21/00069 482/118
8,029,415 B2 10/2011 Ashby et al.
8,033,960 B1 10/2011 Dalebout et al.
D650,451 S 12/2011 Olson et al.
D652,877 S 1/2012 Dalebout et al.
8,152,702 B2 4/2012 Pacheco
D659,775 S 5/2012 Olson et al.
D659,777 S 5/2012 Watterson et al.
D660,383 S 5/2012 Watterson et al.
D664,613 S 7/2012 Dalebout et al.
8,251,874 B2 8/2012 Ashby et al.
8,287,434 B2 10/2012 Zavadsky et al.
8,298,123 B2 10/2012 Hickman
8,298,125 B2 10/2012 Colledge et al.
D671,177 S 11/2012 Sip
D671,178 S 11/2012 Sip
8,323,158 B2 * 12/2012 Keiser ..... A63B 21/00065 482/137
D673,626 S 1/2013 Olson et al.
8,690,735 B2 4/2014 Watterson et al.
D707,763 S 6/2014 Cutler
8,740,753 B2 6/2014 Olson et al.
8,758,201 B2 6/2014 Ashby et al.
8,771,153 B2 7/2014 Dalebout et al.
8,784,270 B2 7/2014 Ashby et al.
8,808,148 B2 8/2014 Watterson et al.
8,814,762 B2 8/2014 Butler et al.
D712,493 S 9/2014 Ercanbrack et al.
8,840,075 B2 9/2014 Dalebout et al.
8,845,493 B2 9/2014 Watterson et al.
8,870,726 B2 10/2014 Watterson et al.
8,876,668 B2 11/2014 Hendrickson et al.
8,894,549 B2 11/2014 Colledge
8,894,555 B2 11/2014 Colledge et al.
8,900,099 B1 12/2014 Boyette
8,911,330 B2 12/2014 Watterson et al.
8,920,288 B2 12/2014 Dalebout et al.
8,986,165 B2 3/2015 Ashby
8,992,364 B2 3/2015 Law et al.
8,992,387 B2 3/2015 Watterson et al.
D726,476 S 4/2015 Ercanbrack
9,028,368 B2 5/2015 Ashby et al.
9,028,370 B2 5/2015 Watterson et al.
9,039,578 B2 5/2015 Dalebout
D731,011 S 6/2015 Buchanan
9,050,496 B2 * 6/2015 Towley, III ..... A63B 21/062
9,050,497 B2 * 6/2015 Reyes ..... A63B 21/062
9,072,930 B2 7/2015 Ashby et al.
9,101,791 B2 8/2015 Boyette
9,119,983 B2 9/2015 Rhea
9,123,317 B2 9/2015 Watterson et al.
9,126,071 B2 9/2015 Smith
9,126,072 B2 9/2015 Watterson
9,138,615 B2 9/2015 Olson et al.
9,142,139 B2 9/2015 Watterson et al.
9,144,703 B2 9/2015 Dalebout et al.
9,149,683 B2 10/2015 Watterson et al.
9,186,535 B2 11/2015 Ercanbrack
9,186,549 B2 11/2015 Watterson et al.
9,254,409 B2 2/2016 Dalebout et al.
9,254,416 B2 2/2016 Ashby
9,278,248 B2 3/2016 Tyger et al.
9,278,249 B2 3/2016 Watterson
9,278,250 B2 3/2016 Buchanan
9,289,648 B2 3/2016 Watterson
9,339,691 B2 5/2016 Brammer
9,352,185 B2 5/2016 Hendrickson et al.
9,352,186 B2 5/2016 Watterson
9,375,605 B2 6/2016 Tyger et al.
9,381,394 B2 7/2016 Mortensen et al.
9,387,387 B2 7/2016 Dalebout
9,393,453 B2 7/2016 Watterson
9,403,047 B2 8/2016 Olson et al.
9,403,051 B2 8/2016 Cutler
9,421,416 B2 8/2016 Mortensen et al.
9,457,219 B2 10/2016 Smith
9,457,220 B2 10/2016 Olson
9,457,222 B2 10/2016 Dalebout
9,460,632 B2 10/2016 Watterson
9,463,356 B2 10/2016 Rhea
9,468,794 B2 10/2016 Barton
9,468,798 B2 10/2016 Dalebout

(56) References Cited

U.S. PATENT DOCUMENTS 9,480,874 B2 11/2016 Cutler
9,492,704 B2 11/2016 Mortensen et al.
9,498,668 B2 11/2016 Smith
9,517,378 B2 12/2016 Ashby et al.
9,521,901 B2 12/2016 Dalebout
9,533,187 B2 1/2017 Dalebout
9,539,461 B2 1/2017 Ercanbrack
9,579,544 B2 2/2017 Watterson
9,586,086 B2 3/2017 Dalebout et al.
9,586,090 B2 3/2017 Watterson et al.
9,604,099 B2 3/2017 Taylor
9,616,276 B2 4/2017 Dalebout et al.
9,616,278 B2 4/2017 Olson
9,623,281 B2 4/2017 Hendrickson et al.
9,636,567 B2 5/2017 Brammer et al.
9,675,839 B2 6/2017 Dalebout et al.
9,682,307 B2 6/2017 Dalebout
9,694,242 B2 7/2017 Ashby et al.
9,707,435 B1 * 7/2017 Ferlito ..... A63B 21/28
9,737,755 B2 8/2017 Dalebout
9,757,605 B2 9/2017 Olson et al.
9,764,186 B2 9/2017 Dalebout et al.
9,767,785 B2 9/2017 Ashby et al.
9,795,822 B2 10/2017 Smith et al.
9,808,672 B2 11/2017 Dalebout
9,849,326 B2 12/2017 Smith
9,878,210 B2 1/2018 Watterson
9,889,334 B2 2/2018 Ashby et al.
9,889,339 B2 2/2018 Douglass
9,937,376 B2 4/2018 Mcinelly et al.
9,937,377 B2 4/2018 Mcinelly et al.
9,937,378 B2 4/2018 Dalebout et al.
9,937,379 B2 4/2018 Mortensen et al.
9,943,719 B2 4/2018 Smith et al.
9,943,722 B2 4/2018 Dalebout
9,948,037 B2 4/2018 Ashby
9,968,816 B2 5/2018 Olson et al.
9,968,821 B2 5/2018 Finlayson et al.
9,968,823 B2 5/2018 Cutler
10,010,755 B2 7/2018 Watterson
10,010,756 B2 7/2018 Watterson
10,029,145 B2 7/2018 Douglass
D826,350 S 8/2018 Hochstrasser
10,046,196 B2 8/2018 Ercanbrack et al.
D827,733 S 9/2018 Hochstrasser
10,065,064 B2 9/2018 Smith et al.
10,071,285 B2 9/2018 Smith et al.
10,080,916 B2 * 9/2018 Lee ..... A63B 21/154
10,085,586 B2 10/2018 Smith et al.
10,086,254 B2 10/2018 Watterson
10,136,842 B2 11/2018 Ashby
10,186,161 B2 1/2019 Watterson
10,188,890 B2 1/2019 Olson et al.
10,207,143 B2 2/2019 Dalebout et al.
10,207,145 B2 2/2019 Tyger et al.
10,207,147 B2 2/2019 Ercanbrack et al.
10,207,148 B2 2/2019 Powell et al.
10,212,994 B2 2/2019 Watterson et al.
10,220,259 B2 3/2019 Brammer
10,226,396 B2 3/2019 Ashby
10,226,664 B2 3/2019 Dalebout et al.
10,252,109 B2 4/2019 Watterson
10,258,828 B2 4/2019 Dalebout et al.
10,272,317 B2 4/2019 Watterson
10,279,212 B2 5/2019 Dalebout et al.
10,293,211 B2 5/2019 Watterson et al.
D852,292 S 6/2019 Cutler
10,335,626 B2 7/2019 Orady et al.
10,343,017 B2 7/2019 Jackson
10,376,736 B2 8/2019 Powell et al.
10,388,183 B2 8/2019 Watterson
10,391,361 B2 8/2019 Watterson
D864,320 S 10/2019 Weston
D864,321 S 10/2019 Weston
10,426,989 B2 10/2019 Dalebout
10,433,612 B2 10/2019 Ashby et al.
10,441,840 B2 10/2019 Dalebout
10,441,844 B2 10/2019 Powell
10,449,416 B2 10/2019 Dalebout et al.
10,471,299 B2 11/2019 Powell
10,486,015 B2 11/2019 Valente et al.
D868,909 S 12/2019 Cutler et al.
10,492,519 B2 12/2019 Capell et al.
10,493,349 B2 12/2019 Watterson
10,500,473 B2 12/2019 Watterson
10,537,764 B2 1/2020 Smith et al.
10,543,395 B2 1/2020 Powell et al.
10,561,877 B2 2/2020 Workman
10,561,893 B2 2/2020 Chatterton et al.
10,561,894 B2 2/2020 Dalebout et al.
10,569,121 B2 2/2020 Watterson
10,569,123 B2 2/2020 Hochstrasser et al.
10,589,163 B2 3/2020 Orady et al.
10,617,903 B2 4/2020 Orady et al.
10,625,114 B2 4/2020 Ercanbrack
10,625,137 B2 4/2020 Dalebout et al.
10,661,112 B2 5/2020 Orady et al.
10,661,114 B2 5/2020 Watterson et al.
10,668,320 B2 6/2020 Watterson
10,671,705 B2 6/2020 Capell et al.
10,688,346 B2 6/2020 Brammer
10,702,736 B2 7/2020 Weston et al.
10,709,925 B2 7/2020 Dalebout et al.
10,726,730 B2 7/2020 Watterson
10,729,965 B2 8/2020 Powell
10,758,767 B2 9/2020 Olson et al.
10,786,706 B2 9/2020 Smith
10,792,539 B1 10/2020 Gilstrom et al.
10,864,407 B2 12/2020 Watterson et al.
10,874,905 B2 12/2020 Belson et al.
10,881,890 B2 1/2021 Orady et al.
10,918,899 B2 2/2021 Gisin et al.
10,918,905 B2 2/2021 Powell et al.
D912,168 S 3/2021 Orady et al.
10,932,517 B2 3/2021 Ashby et al.
10,940,360 B2 3/2021 Dalebout et al.
10,953,268 B1 3/2021 Dalebout et al.
10,953,305 B2 3/2021 Dalebout et al.
10,960,258 B2 3/2021 Parsian et al.
10,967,214 B1 4/2021 Olson et al.
10,987,565 B2 4/2021 Orady et al.
10,994,173 B2 5/2021 Watterson
11,000,730 B2 5/2021 Dalebout et al.
11,000,735 B2 5/2021 Orady et al.
11,013,960 B2 5/2021 Watterson et al.
D921,132 S 6/2021 Orady et al.
11,033,777 B1 6/2021 Watterson et al.
11,058,913 B2 7/2021 Dalebout et al.
11,058,914 B2 7/2021 Powell
11,058,918 B1 7/2021 Watterson et al.
11,065,496 B2 * 7/2021 Leipheimer ..... A63B 21/078
11,077,330 B2 8/2021 Orady et al.
11,110,317 B2 9/2021 Valente et al.
11,123,592 B2 9/2021 Orady et al.
11,154,752 B2 10/2021 Azaria et al.
11,187,285 B2 11/2021 Wrobel
11,219,794 B2 1/2022 Orady et al.
11,285,351 B2 3/2022 Orady et al.
11,285,355 B1 3/2022 Nicholson et al.
11,324,983 B2 5/2022 Orady et al.
2002/0091043 A1 * 7/2002 Rexach ..... A63B 21/0628 482/99
2007/0179030 A1 * 8/2007 Slawinski ..... A63B 21/0724 482/99
2008/0051256 A1 2/2008 Ashby et al.
2010/0125026 A1 5/2010 Zavadsky et al.
2011/0251021 A1 10/2011 Zavadsky et al.
2013/0065680 A1 3/2013 Zavadsky et al.
2015/0080184 A1 3/2015 Boyette
2015/0306459 A1 10/2015 Boyette
2016/0058335 A1 3/2016 Ashby
2016/0303453 A1 10/2016 Kim
2016/0346595 A1 12/2016 Dalebout et al.
2017/0319941 A1 11/2017 Smith et al.

(56) References Cited

U.S. PATENT DOCUMENTS

| | | | |
|---|---|---|---|
| 2018/0021616 | A1 | 1/2018 | Orady et al. |
| 2019/0099632 | A1 | 4/2019 | Orady et al. |
| 2019/0099633 | A1 | 4/2019 | Orady et al. |
| 2019/0099637 | A1 | 4/2019 | Valente et al. |
| 2019/0099652 | A1 | 4/2019 | Orady et al. |
| 2019/0262652 | A1 | 8/2019 | Orady et al. |
| 2019/0299043 | A1 | 10/2019 | Gisin et al. |
| 2019/0299049 | A1 | 10/2019 | Parsian et al. |
| 2020/0047031 | A1 | 2/2020 | Orady et al. |
| 2020/0054914 | A1 | 2/2020 | Lafrance et al. |
| 2020/0054922 | A1 | 2/2020 | Azaria et al. |
| 2020/0070032 | A1 | 3/2020 | Orady et al. |
| 2020/0238128 | A1 | 7/2020 | Valente et al. |
| 2020/0261771 | A1 | 8/2020 | Belson et al. |
| 2020/0276465 | A1 | 9/2020 | Orady et al. |
| 2020/0298049 | A1 | 9/2020 | Valente et al. |
| 2020/0298062 | A1 | 9/2020 | Gilstrom et al. |
| 2020/0316424 | A1 | 10/2020 | Orady et al. |
| 2020/0330847 | A1 | 10/2020 | Orady et al. |
| 2021/0008401 | A1 | 1/2021 | Orady et al. |
| 2021/0008402 | A1 | 1/2021 | Orady et al. |
| 2021/0023417 | A1 | 1/2021 | Hand et al. |
| 2021/0038937 | A1 | 2/2021 | Orady et al. |
| 2021/0038938 | A1 | 2/2021 | Orady et al. |
| 2021/0069553 | A1 | 3/2021 | Belson et al. |
| 2021/0128964 | A1 | 5/2021 | Gisin et al. |
| 2021/0128978 | A1 | 5/2021 | Gilstrom et al. |
| 2021/0154531 | A1 | 5/2021 | Gilstrom et al. |
| 2021/0170212 | A1 | 6/2021 | Lafrance et al. |
| 2021/0170213 | A1 | 6/2021 | Orady et al. |
| 2021/0170214 | A1 | 6/2021 | Orady et al. |
| 2021/0236877 | A1 | 8/2021 | Parsian et al. |
| 2021/0236907 | A1 | 8/2021 | Orady et al. |
| 2021/0291021 | A1 | 9/2021 | Orady et al. |
| 2021/0379436 | A1 | 12/2021 | Orady et al. |
| 2021/0394023 | A1 | 12/2021 | Belson et al. |
| 2021/0402259 | A1 | 12/2021 | Belson et al. |
| 2022/0032114 | A1 | 2/2022 | Valente et al. |
| 2022/0032115 | A1 | 2/2022 | Mallard et al. |
| 2022/0032121 | A1 | 2/2022 | Mallard et al. |
| 2022/0032158 | A1 | 2/2022 | Mallard et al. |
| 2022/0032159 | A1 | 2/2022 | Mallard et al. |
| 2022/0062680 | A1 | 3/2022 | Orady et al. |
| 2022/0118301 | A1 | 4/2022 | Valente et al. |
| 2022/0118304 | A1 | 4/2022 | Mcnally et al. |
| 2022/0118316 | A1 | 4/2022 | Azaria et al. |
| 2022/0143454 | A1 | 5/2022 | Nicholson et al. |
| 2022/0176184 | A1 | 6/2022 | Orady et al. |
| 2022/0184452 | A1 | 6/2022 | Valente et al. |

FOREIGN PATENT DOCUMENTS

| | | | |
|---|---|---|---|
| CN | 112384288 | A | 2/2021 |
| CN | 112399876 | A | 2/2021 |
| CN | 113164805 | A | 7/2021 |
| CN | 113164808 | A | 7/2021 |
| CN | 113195062 | A | 7/2021 |
| EP | 3 487 591 | A1 | 5/2019 |
| EP | 3 487 591 | A4 | 5/2019 |
| EP | 3 691 758 | A2 | 8/2020 |
| EP | 3 691 758 | A4 | 8/2020 |
| EP | 3 773 940 | A1 | 2/2021 |
| EP | 3 773 940 | A4 | 2/2021 |
| EP | 3 833 453 | A1 | 6/2021 |
| EP | 3 833 453 | A4 | 6/2021 |
| EP | 3 837 023 | A1 | 6/2021 |
| EP | 3 837 023 | A4 | 6/2021 |
| EP | 3 837 024 | A1 | 6/2021 |
| EP | 3 837 024 | A4 | 6/2021 |
| WO | WO-2019/070436 | A2 | 4/2019 |
| WO | WO-2019/070436 | A3 | 4/2019 |
| WO | WO-2019/191658 | A1 | 10/2019 |
| WO | WO-2019/191662 | A1 | 10/2019 |
| WO | WO-2020/033650 | A1 | 2/2020 |
| WO | WO-2020/033657 | A1 | 2/2020 |
| WO | WO-2020/036989 | A1 | 2/2020 |
| WO | WO-2020/036990 | A1 | 2/2020 |
| WO | WO-2020/167356 | A1 | 8/2020 |
| WO | WO-2021/086410 | A1 | 5/2021 |
| WO | WO-2021/236594 | A1 | 11/2021 |
| WO | WO-2022/005852 | A1 | 1/2022 |
| WO | WO-2022/026464 | A1 | 2/2022 |
| WO | WO-2022/040033 | A1 | 2/2022 |
| WO | WO-2022/086857 | A1 | 4/2022 |
| WO | WO-2022/132790 | A1 | 6/2022 |
| WO | WO-2022/132814 | A1 | 6/2022 |

OTHER PUBLICATIONS

Chinese Office Action for Application No. 202080013335.0 dated Jul. 1, 2022 (7 pages).

U.S. Appl. No. 63/316,890, filed Mar. 4, 2022, iFIT Inc.

U.S. Office Action on U.S. Appl. No. 16/780,765 dated Nov. 26, 2021.

* cited by examiner

EXERCISE MACHINE

CROSS-REFERENCE TO RELATED APPLICATIONS

This application is a continuation of U.S. patent application Ser. No. 16/780,765, filed Feb. 3, 2020, which claims the benefit of and priority to U.S. Provisional Patent Application No. 62/804,146, filed Feb. 11, 2019, each of which is incorporated herein by reference in its entirety for all that it discloses.

BACKGROUND

A cable exercise machine is a popular piece of exercise equipment for improving muscular definition and strength. Some benefits of a cable exercise machine are that it may enable a user to easily isolate muscles. However, use of a cable exercise machine may result in individual muscles becoming stronger while other muscles are left weak. This may be due to the cable exercise machine adjusting, balancing, and supporting the user's body, resulting in weaker muscles that would normally do these tasks in real life.

Free weights are also popular for improving muscular definition and strength. In contrast to using a cable exercise machine, using free weights tends to require a user to use more than one muscle group for each exercise, and may generally result in less muscle isolation.

The subject matter claimed herein is not limited to embodiments that solve any disadvantages or that operate only in environments such as those described above. Rather, this background is only provided to illustrate one example technology area where some embodiments described herein may be practiced.

SUMMARY

In one aspect of the disclosure, an exercise machine may include a frame, a resistance mechanism supported by the frame, a first pull cable and a second pull cable supported by the frame and linked to the resistance mechanism, and a power rack attached to the frame. The power rack may include a first upright post configured to have a first barbell holder adjustably attached thereto and a second upright post configured to have a second barbell holder adjustably attached thereto. The first barbell holder may be adjusted in various positions between a first highest position and a first lowest position on the first upright post. The second barbell holder may also be adjusted in various positions between a second highest position and a second lowest position on the second upright post.

Another aspect of the disclosure may include any combination of the above-mentioned features and may further include a first tensioner spring configured to reduce slack in the first pull cable, and a second tensioner spring configured to reduce slack in the second pull cable.

Another aspect of the disclosure may include any combination of the above-mentioned features and may further include a first pulley configured to selectively receive the first pull cable to enable the first pull cable to be selectively attached to a barbell to enable the first tensioner spring to assist a user in lifting the barbell, and a second pulley configured to selectively receive the second pull cable to enable the second pull cable to be selectively attached to the barbell to enable the second tensioner spring to assist the user in lifting the barbell.

Another aspect of the disclosure may include any combination of the above-mentioned features and may further include the first tensioner spring being configured to provide between 3-5 pounds, between 2-8 pounds, between 1-11 pounds, or between 2-20 pounds of force assisting the user in lifting the barbell, and the second tensioner spring being configured to provide between 3-5 pounds, between 2-8 pounds, between 1-11 pounds, or between 2-20 pounds of force assisting the user in lifting the barbell.

Another aspect of the disclosure may include any combination of the above-mentioned features and may further include a first tensioner spring configured to reduce slack in the first pull cable, a second tensioner spring configured to reduce slack in the second pull cable, a first pulley configured to selectively receive the first pull cable to enable the first pull cable to be selectively attached to a barbell to enable the first tensioner spring to hinder a user in lifting the barbell, and a second pulley configured to selectively receive the second pull cable to enable the second pull cable to be selectively attached to the barbell to enable the second tensioner spring to hinder the user in lifting the barbell.

Another aspect of the disclosure may include any combination of the above-mentioned features and may further include the first tensioner spring being configured to provide between 3-5 pounds, between 2-8 pounds, between 1-11 pounds, or between 2-20 pounds of force hindering the user in lifting the barbell, and the second tensioner spring being configured to provide between 3-5 pounds, between 2-8 pounds, between 1-11 pounds, or between 2-20 pounds of force hindering the user in lifting the barbell.

Another aspect of the disclosure may include any combination of the above-mentioned features and may further include the resistance mechanism being configured to be selectively set at one of multiple resistance levels, and the first pulley and the second pulley enabling the resistance mechanism to hinder the user in lifting the barbell in proportion to the set resistance level of the resistance mechanism.

Another aspect of the disclosure may include any combination of the above-mentioned features and may further include the resistance mechanism including a flywheel and one or more magnets arranged to selectively resist rotation of the flywheel.

Another aspect of the disclosure may include any combination of the above-mentioned features and may further include the resistance mechanism including a motor.

Another aspect of the disclosure may include any combination of the above-mentioned features and may further include a motor supported by the frame and linked to the first pull cable and to the second pull cable, a first pulley configured to selectively receive the first pull cable to enable the first pull cable to be selectively attached to a barbell to enable the motor to assist a user in lifting the barbell, and a second pulley configured to selectively receive the second pull cable to enable the second pull cable to be selectively attached to the barbell to enable the motor to assist the user in lifting the barbell.

Another aspect of the disclosure may include any combination of the above-mentioned features and may further include the power rack further including a pull-up bar supported by the first upright post and by the second upright post.

Another aspect of the disclosure may include any combination of the above-mentioned features and may further include the power rack further including a first weight plate holder supported by the first upright post, and a second weight plate holder supported by the second upright post.

Another aspect of the disclosure may include any combination of the above-mentioned features and may further include the first barbell holder and the second barbell holder being configured as spotter arms to prevent a barbell from falling on a user if the user is unable to continue lifting the barbell.

Another aspect of the disclosure may include any combination of the above-mentioned features and may further include one or more dumbbell racks supported by the frame and each configured to hold a dumbbell.

In another aspect of the disclosure, an exercise machine may include a frame, a resistance mechanism supported by the frame, a first pull cable and a second pull cable supported by the frame and linked to the resistance mechanism, and a bottom-out mechanism configured to prevent the first pull cable and the second pull cable from being fully extended.

Another aspect of the disclosure may include any combination of the above-mentioned features and may further include the bottom-out mechanism including a first visual indicator on the first pull cable and a second visual indicator on the second pull cable.

Another aspect of the disclosure may include any combination of the above-mentioned features and may further include the bottom-out mechanism including a sensor configured to trigger when one or more of the first pull cable and/or the second pull cable has been extended to within a threshold of being fully extended, a user has moved past a threshold distance from the exercise machine, or a barbell has moved past a threshold distance from the exercise machine.

Another aspect of the disclosure may include any combination of the above-mentioned features and may further include the bottom-out mechanism further including an alarm configured, in response to the sensor triggering, to alert the user of a danger of the first pull cable and/or the second pull cable being fully extended.

Another aspect of the disclosure may include any combination of the above-mentioned features and may further include the bottom-out mechanism further including one or more brakes configured, in response to the sensor triggering, to engage the first pull cable and/or the second pull cable to prevent the first pull cable and/or the second pull cable from being fully extended.

Another aspect of the disclosure may include any combination of the above-mentioned features and may further include the sensor including one or more of an optical sensor, a magnetic sensor, a camera sensor, or an infrared sensor.

Another aspect of the disclosure may include any combination of the above-mentioned features and may further include the exercise machine further including a power rack attached to the frame and configured to have a first barbell holder and a second barbell holder adjustably attached thereto, the exercise machine further including a first tensioner spring configured to reduce slack in the first pull cable, the exercise machine further comprises a second tensioner spring configured to reduce slack in the second pull cable, the exercise machine further including a first pulley configured to selectively receive the first pull cable to enable the first pull cable to be selectively attached to a barbell to enable the first tensioner spring to assist a user in lifting the barbell, the exercise machine further including a second pulley configured to selectively receive the second pull cable to enable the second pull cable to be selectively attached to the barbell to enable the second tensioner spring to assist the user in lifting the barbell, and the bottom-out mechanism being further configured to prevent the first pull cable and the second pull cable from being fully extended to avoid a user of the barbell, with the first pull cable and the second pull cable selectively attached thereto, from being prevented from moving a muscle group through a full range of motion while lifting the barbell.

It is to be understood that both the foregoing summary and the following detailed description are explanatory and are not restrictive of the invention as claimed.

BRIEF DESCRIPTION OF THE DRAWINGS

Embodiments will be described and explained with additional specificity and detail through the use of the accompanying drawings in which.

Throughout the drawings, identical reference numbers designate similar, but not necessarily identical, elements.

DETAILED DESCRIPTION

Figure 1A:
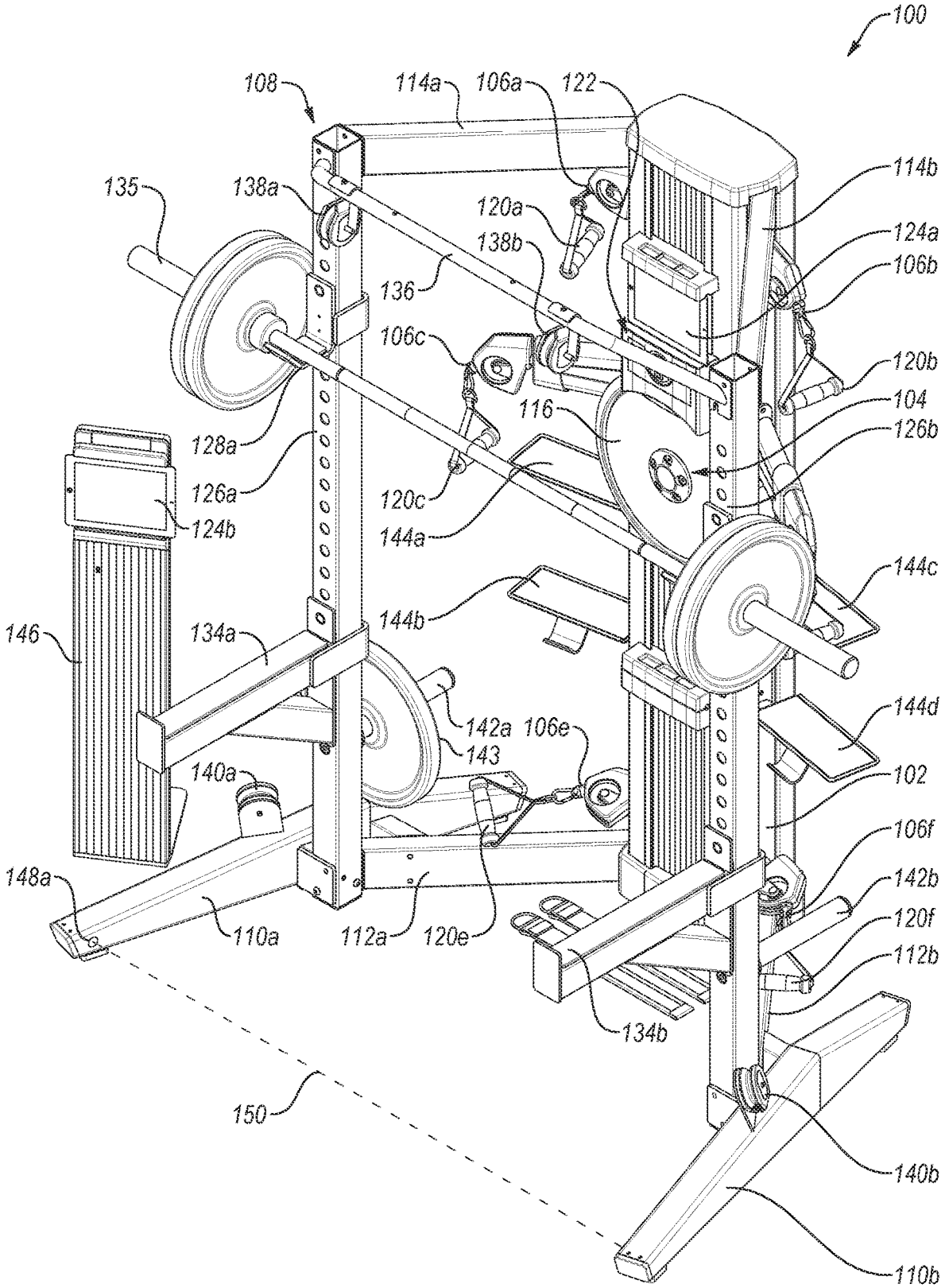
FIGS. 1A-1E are front-right, front, right, rear, and top views, respectively, of an example cable and power rack exercise machine.
Figure 1B:
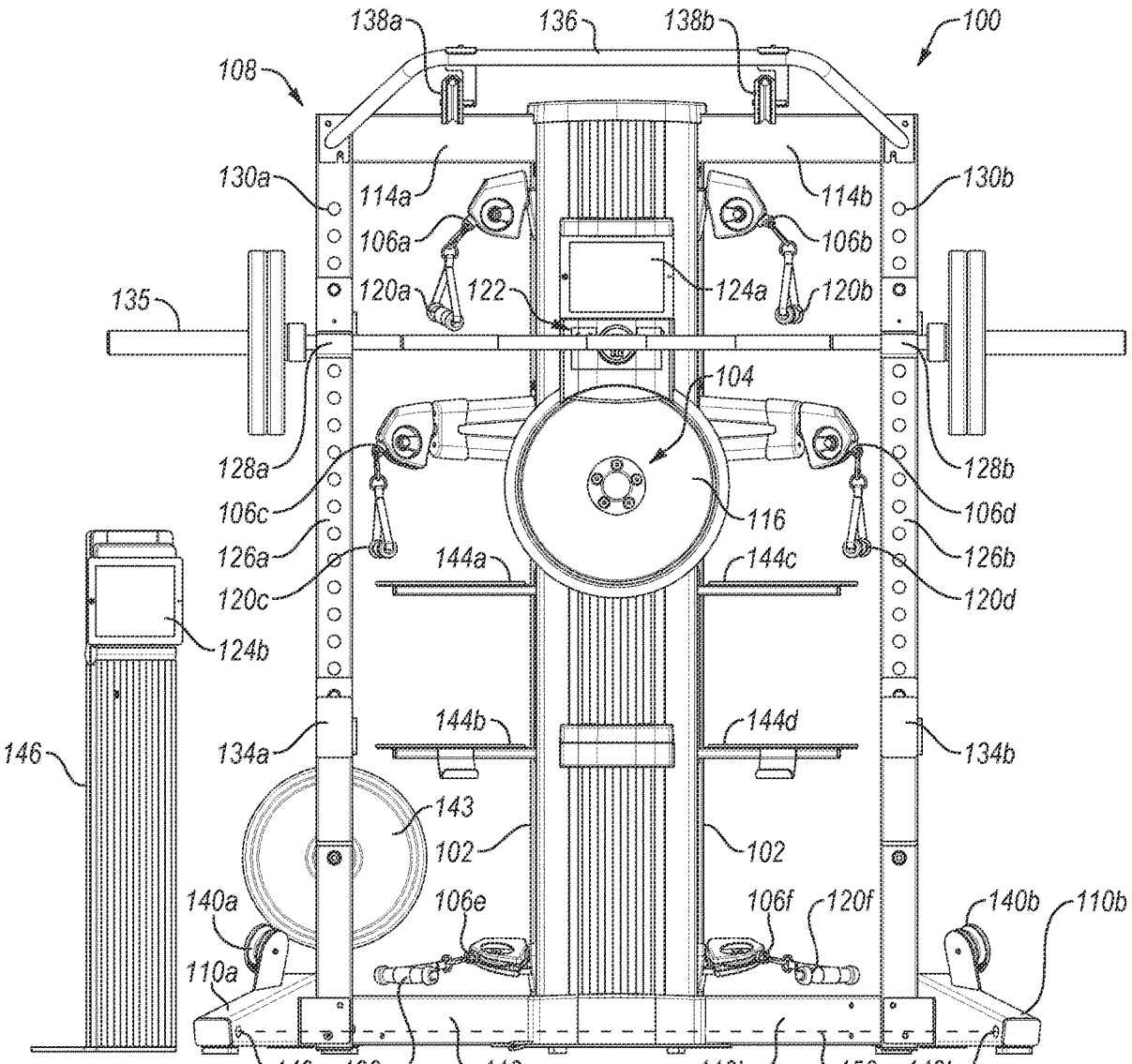

Some embodiments disclosed herein include a cable and power rack exercise machine. For example, the example exercise machine disclosed herein may combine features of a cable machine and features of a power rack to yield a superior exercise machine where cables of the exercise machine can be attached to a barbell to assist the user in performing a workout with the barbell. This assistance may come in the form of making the barbell easier to lift or harder to lift, depending on the desired effect. The exercise machine may also include certain bottom-out features that prevent the cables from being fully extended in order to maintain the effective assistance of the cables while pulling on the cables alone or when the cables are attached to the barbell. In this manner, the example exercise machine disclosed herein may enable a user to perform both cable exercises as well as free weight exercises.

Turning now to the drawings, 1A-1E are front-right, front, right, rear, and top views, respectively, of an example cable and power rack exercise machine. The exercise machine 100 may include a frame 102, a resistance mechanism 104 supported by the frame 102, and pull cables 106*a*-106*f* supported by the frame 102 and linked to the resistance mechanism 104, and a power rack 108 attached to the frame 102.

The frame 102 may be supported by a base that may include left and right legs 110*a* and 110*b* and left and right lower supports 112*a* and 112*b*. The frame may also include left and right upper supports 114*a* and 114*b*.

The resistance mechanism 104 may include a flywheel 116 and one or more magnets 118 arranged to selectively resist rotation of the flywheel 116 (which may be either permanent magnets configured to be repositioned or electromagnets configured to have magnetic strength adjusted). The pull cables 106*a*-106*f* may have handles 120*a*-120*f* attached thereto, respectively, such that a user can pull on any of the pull cables 106*a*-106*f* by pulling on the corresponding handle 120*a*-120*f*. The pull cables 106*a*-106*f* may be linked to the resistance mechanism 104, via multiple pulleys, spools, other cables, etc, such that the resistance mechanism 104 can apply a set level of resistance to a user pulling on any one of the pull cables 106*a*-106*f*. The level of resistance applied by the resistance mechanism 104 may be at least partially controlled by a console 122, and/or may be at least partially controlled by a tablet 124*a* or 124*b* that is in wired or wireless communication (e.g., Bluetooth communication) with the console 122.

The pull cables 106*a*-106*f* may be further linked to left and right tensioner springs 125*a* and 125*b* that are configured to reduce slack in the pull cables 106*a*-106*f*. More particularly, the left tensioner spring 125*a* may be configured to reduce slack in the left-side pull cables 106*a*, 106*c*, and 106*e*, while the right tensioner spring 125*b* may be configured to reduce slack in the right-side pull cables 106*b*, 106*d*, and 106*f*. For example, after a user pulls on one of the pull cables 106*a*-106*f*, the left tensioner spring 125*a* or the right tensioner spring 125*b* may be configured to retract the pull cable back to its fully-retracted position.

The power rack 108 may include left and right upright posts 126*a* and 126*b* that are attached to the frame 102 via the left and right lower supports 112*a* and 112*b* and the left and right upper supports 114*a* and 114*b*, respectively. The left and right upright posts 126*a* and 126*b* may be configured to have left and right barbell holders 128*a* and 128*b*, respectively, adjustably attached thereto. The left and right barbell holders 128*a* and 128*b* may be adjusted in various positions between left and right highest positions 130*a* and 130*b* and left and right lowest positions 132*a* and 132*b* on the left and right upright posts 126*a* and 126*b*, respectively. The left and right upright posts 126*a* and 126*b* may be configured to have left and right spotter arms 134*a* and 134*b*, respectively, adjustably attached thereto. The left and right spotter arms 134*a* and 134*b* may also be adjusted in various positions between the left and right highest positions 130*a* and 130*b* and the left and right lowest positions 132*a* and 132*b* on the left and right upright posts 126*a* and 126*b*, respectively. The left and right barbell holders 128*a* and 128*b* and/or the left and right spotter arms 134*a* and 134*b* may be configured to prevent a barbell 135 from falling on a user if the user is unable to continue lifting the barbell 135.

The power rack 108 may further include a pull-up bar 136 supported by the left and right upright posts 126*a* and 126*b*. The pull-up bar 136 may be configured to allow a user to perform pull-ups on the power rack 108. The power rack 108 may further include left and right upper pulleys 138*a* and 138*b* supported by the pull-up bar 136 and left and right lower pulleys 140*a* and 140*b* supported by the left and right legs 110*a* and 110*b*, respectively. The power rack 108 may further include left and right weight plate holders 142*a* and 142*b* supported by the left and right upright posts 126*a* and 126*b* configured for storage of weight plates, such as the weight plate 143. The power rack 108 may further include dumbbell racks 144*a*-144*d* supported by the frame 102 and each configured to hold a dumbbell (not shown).

The exercise machine 100 may further include a tablet holder 146 configured to hold the tablet 124*a*, or to hold a second tablet 124*b*, so that when the user is faced away from the console 122, and/or from the tablet 124*a* mounted above the console 122, the user may continue to view a tablet connected to the console 122 of the exercise machine 100, and to control the exercise machine 100 using the tablet, without having to turn around.

Figure 1C:
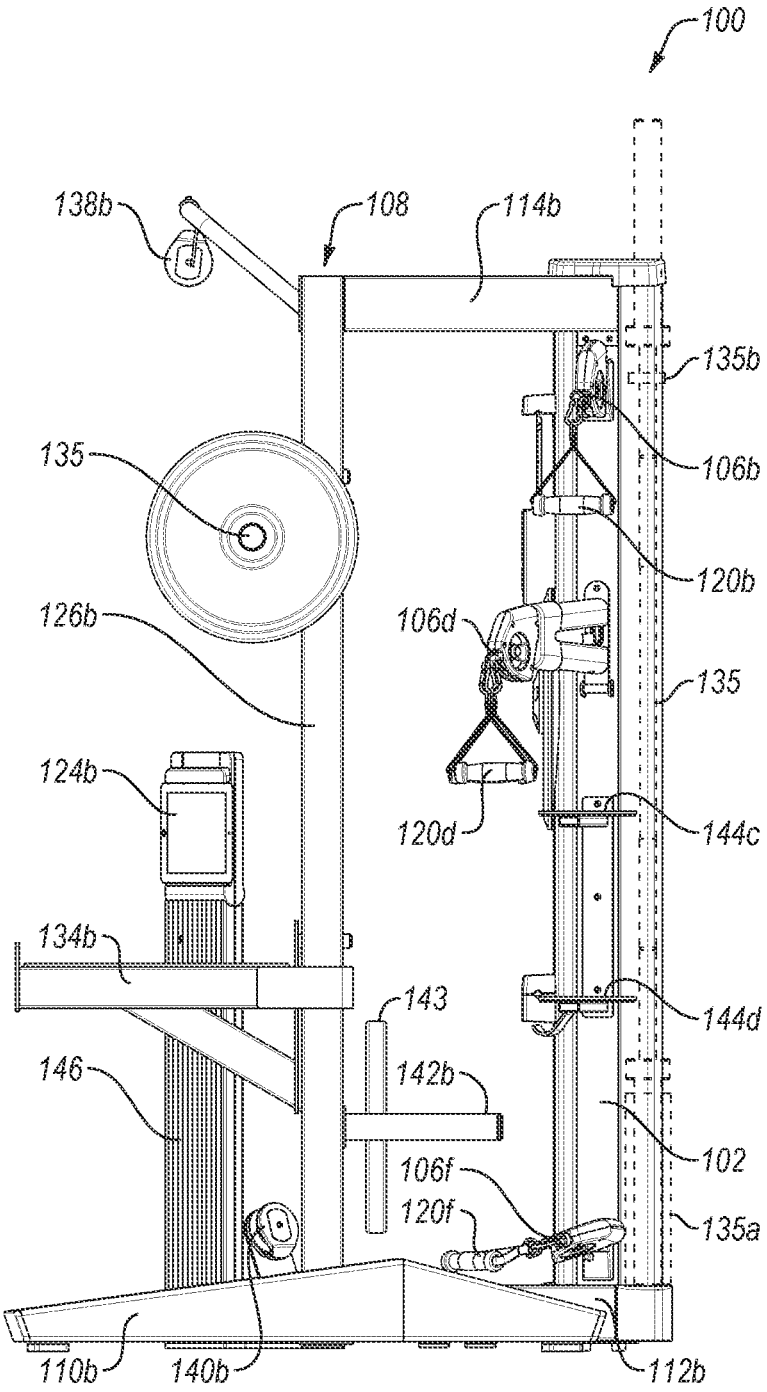
Figure 1D:
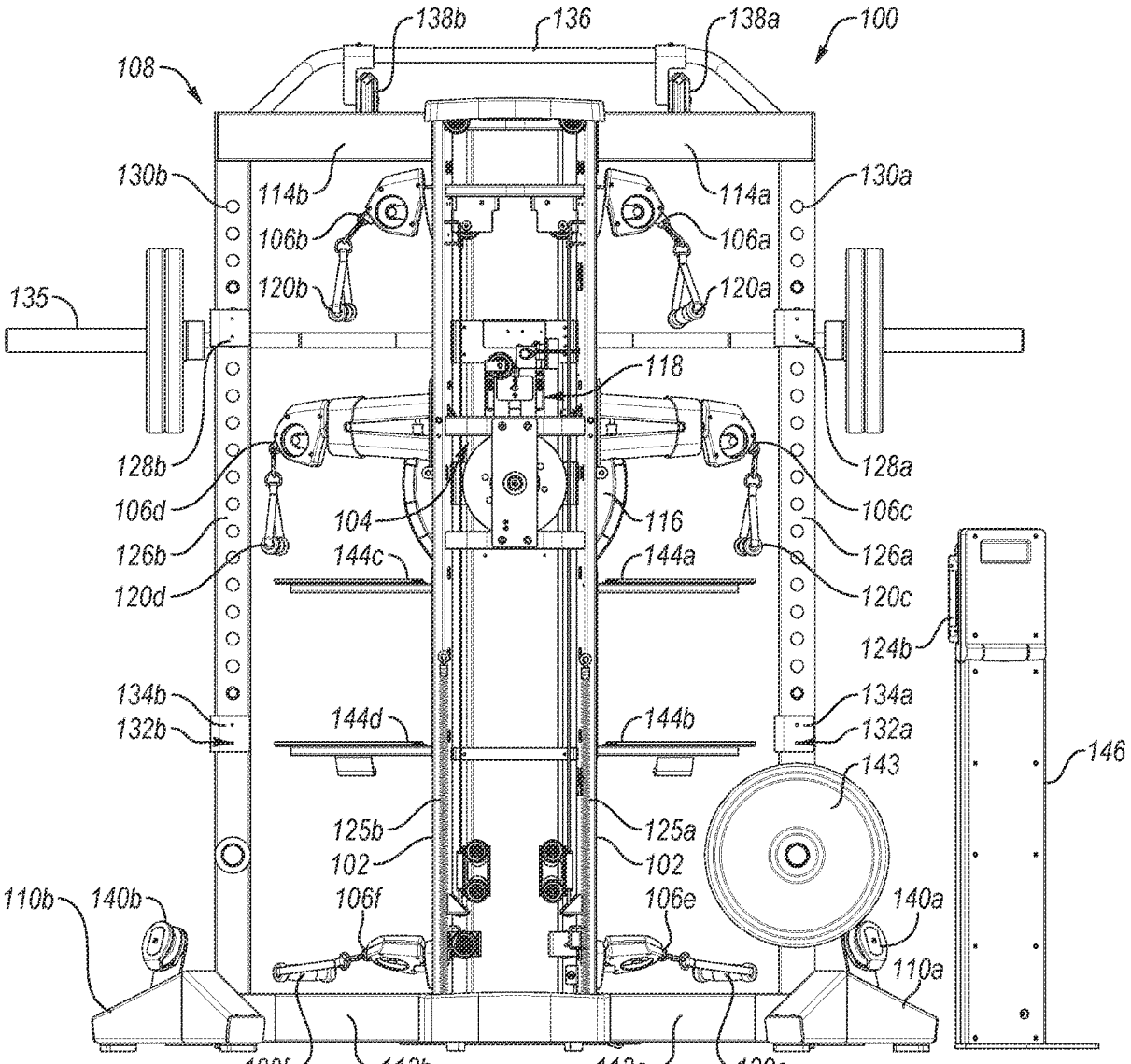
Figure 1E:
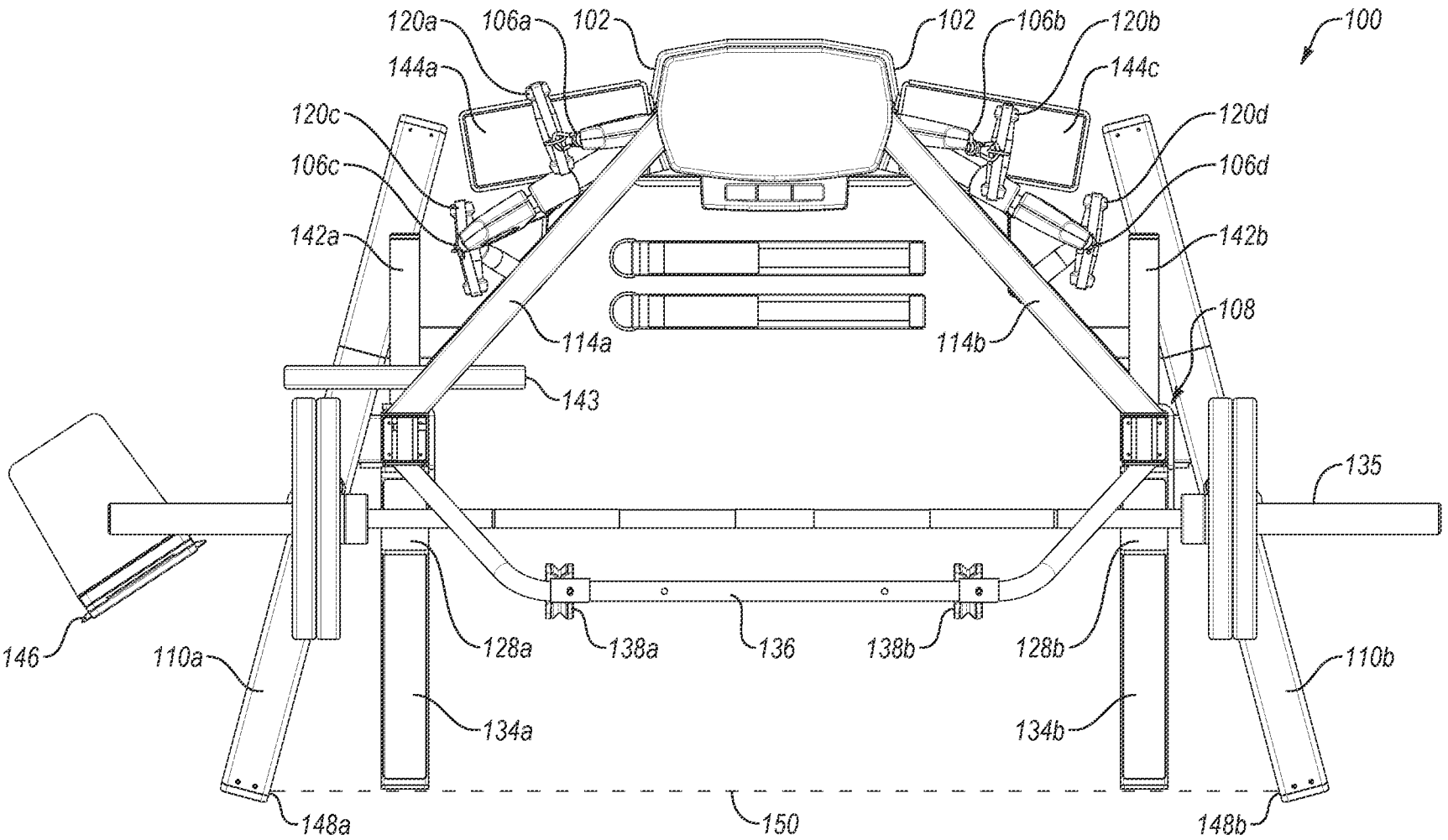

The exercise machine 100 may further include a barbell retention device (see FIG. 1C). The barbell retention device may include a tube 135*a* attached to the frame 102 and configured to be large enough in diameter to receive one end of the barbell 135 (or another barbell) when a user desires to store the barbell 135*a* because it is not currently in use. The barbell retention device may additionally or alternatively include a strap 135*b* attached to the frame 102 and configured to wrap around the other end of the barbell 135 (or another barbell) to keep the barbell 135 securely positioned against the frame 102. The strap 135*b* may be a buckle strap, a hook and loop strap, or any other type of strap.

The exercise machine 100 may further include a bottom-out mechanism configured to prevent the pull cables 106*a*-106*f* from being fully extended, also known as bottoming-out or dead-ending. For example, this bottom-out mechanism may include left and right sensors 148*a* and 148*b* positioned on the left and right legs 110*a* and 110*b*, respectively. The left and right sensors 148*a* and 148*b* may include one or more of an optical sensor, a magnetic sensor, a camera sensor, or an infrared sensor, or some other sensor. The left and right sensors 148*a* and 148*b* may be configured to trigger when any of the pull cables 106*a*-106*f* has been extended to within a threshold of being fully extended (e.g., within 2 feet of being fully extended), when a user has moved past a threshold distance from the exercise machine 100 (such as past the line 150), or when a barbell (such as the barbell 135, which may be a standard Olympic 44-pound or 45-pound barbell) has moved past a threshold distance (such as past the line 150) from the exercise machine 100, among other triggering events. In response to the triggering of the left and right sensors 148*a* and 148*b*, an alarm may alert the user of a danger of any of the pull cables 106*a*-106*f* being fully extended, or the danger of some other event.

Figure 2A:
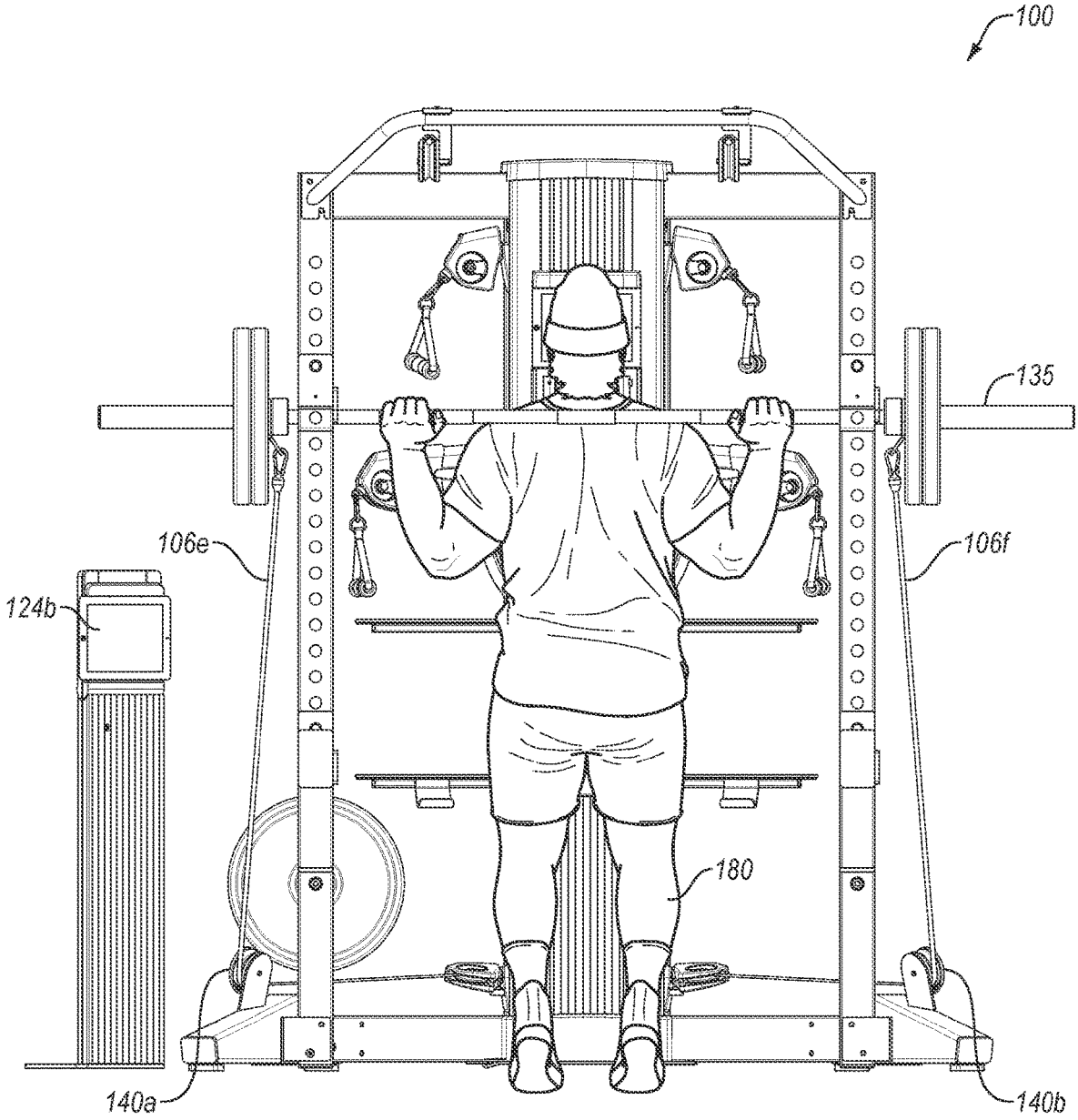
FIGS. 2A-2C illustrate a user preparing to lift, lifting, and squatting with a barbell using the example cable and power rack exercise machine of FIGS. 1A-1E.
Figure 2B:
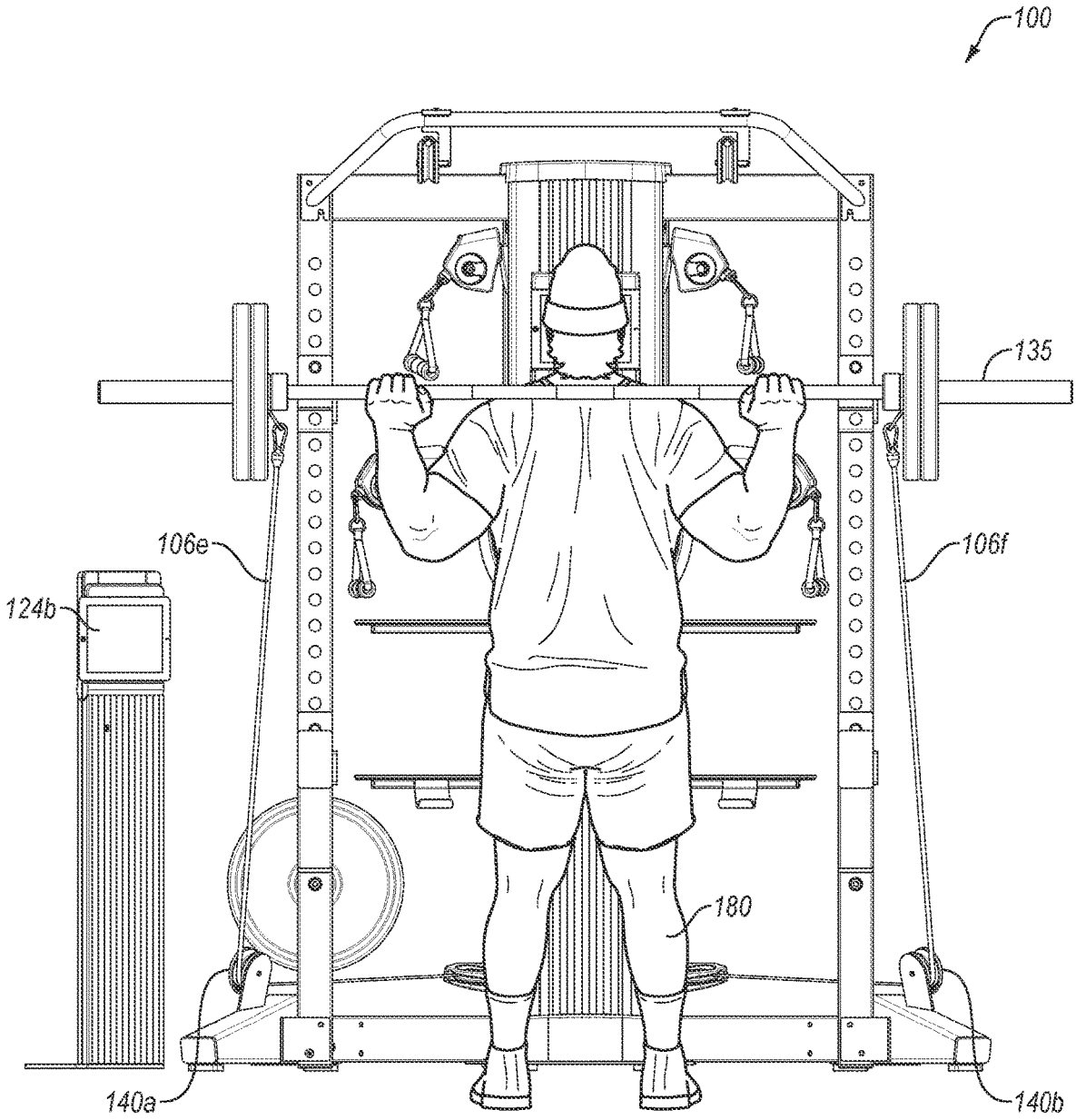
Figure 2C:
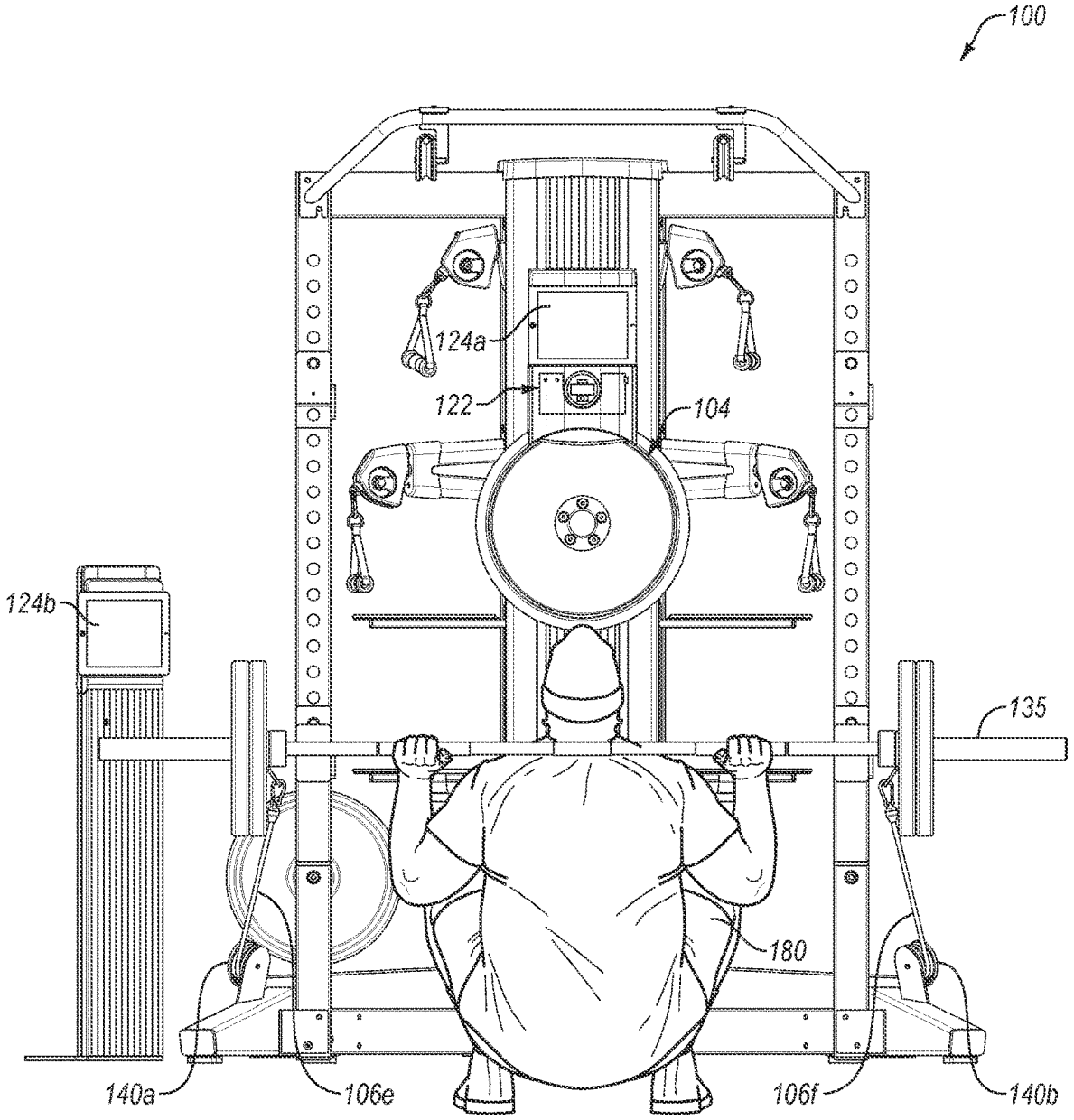

FIGS. 2A-2C illustrate a user 180 preparing to lift, lifting, and squatting with the barbell 135 using the example cable and power rack exercise machine 100 of FIGS. 1A-1E. As illustrated in FIGS. 2A-2C, the left and right lower pulleys 140*a* and 140*b* may be configured to selectively receive the pull cables 106*e* and 106*f*, respectively, after the handles 120*e* and 120*f* have been detached therefrom, in order to enable the pull cables 106*e* and 106*f* to be selectively attached to the barbell 135. This selective attachment of the pull cables 106*e* and 106*f* to the barbell 135 in this manner may enable the left and right tensioner springs 125*a* and 125*b* (see FIG. 1D) to hinder the user 180 in lifting the barbell 135. For example, the left and right tensioner springs 125*a* and 125*b* may each include a spring constant of a particular value of pounds of force per inch (lbf/in). The spring constant may be configured to provide a particular amount of force hindering the user 180 when lifting the barbell 135 as disclosed in FIGS. 2A-2C. For example, the left and right tensioner springs 125*a* and 125*b* may be configured to provide a hindering force between 3-5 pounds, between 2-8 pounds, between 1-11 pounds, or between 2-20 pounds hindering the user 180 when lifting the barbell 135 as disclosed in FIGS. 2A-2C. This force hindering the user 180 may change the more the left and right tensioner springs 125*a* and 125*b* are stretched, following a load versus deflection curve. As disclosed in FIGS. 2A-2C, the force hindering the user 180 may increase as the user 180 lifts the barbell 135 (because the left and right tensioner springs 125*a* and 125*b* become increasingly stretched), and may decrease as the user 180 lowers the barbell 135 (because the left and right tensioner springs 125*a* and 125*b* become decreasingly stretched). In this manner, the left and right tensioner springs 125*a* and 125*b* may hinder the user 180 most when the barbell 135 is at its highest point and when the user 180 may desire hindrance most due to the user 180 having the most amount of leverage. Further, the resistance mechanism 104 may be configured to be selectively set at one of multiple resistance levels, using the console 122 and/or the tablet

124*a* or 124*b* for example, and the selective attachment of the pull cables 106*e* and 106*f* to the barbell 135 via the left and right lower pulleys 140*a* and 140*b* may further enable the resistance mechanism 104 to hinder the user 180 in lifting the barbell 135 in proportion to the set resistance level of the resistance mechanism 104.

Figure 3A:
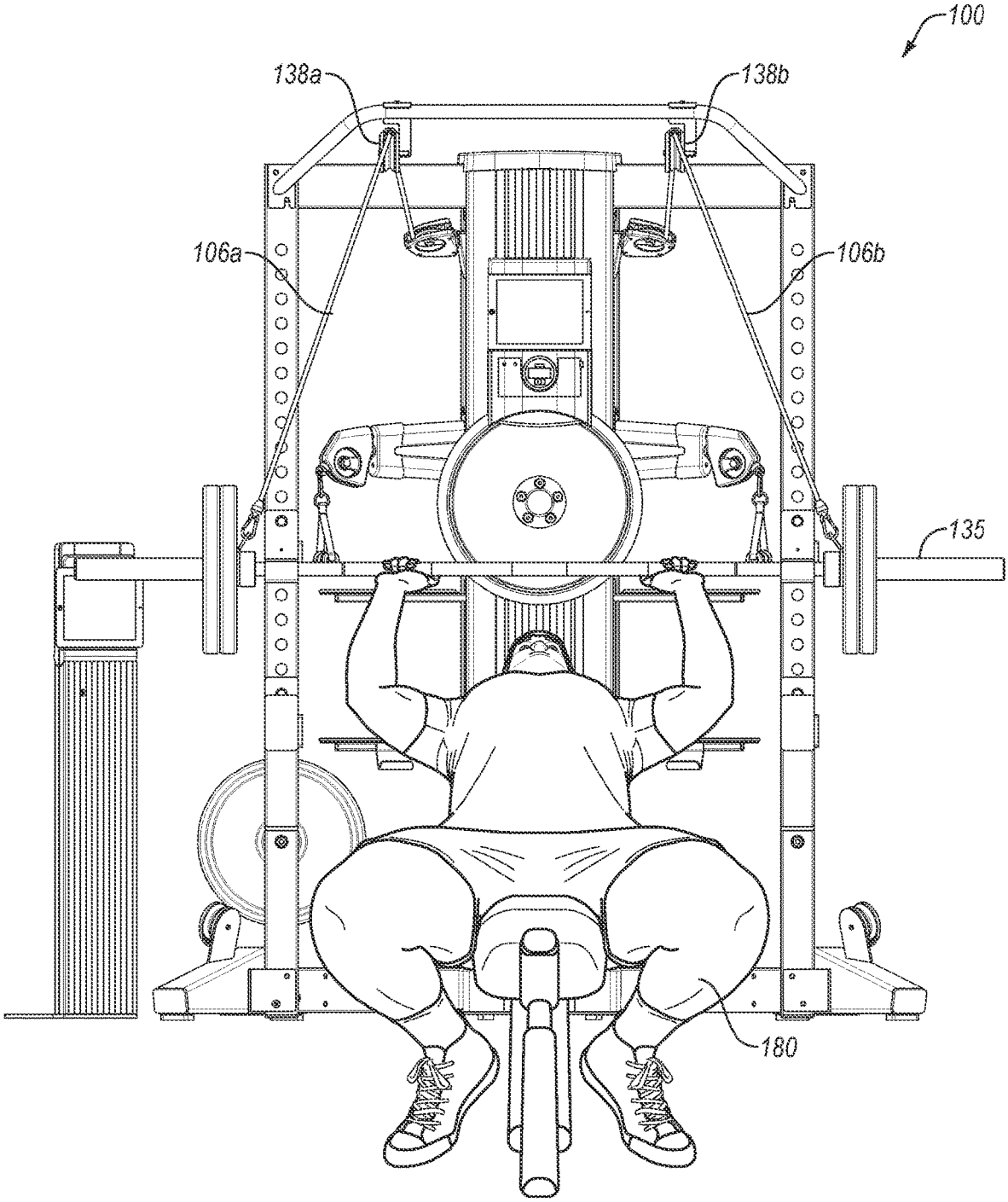
FIGS. 3A-3C illustrate a user preparing to lift, lifting, and lowering a barbell using the example cable and power rack exercise machine of FIGS. 1A-1E.
Figure 3B:
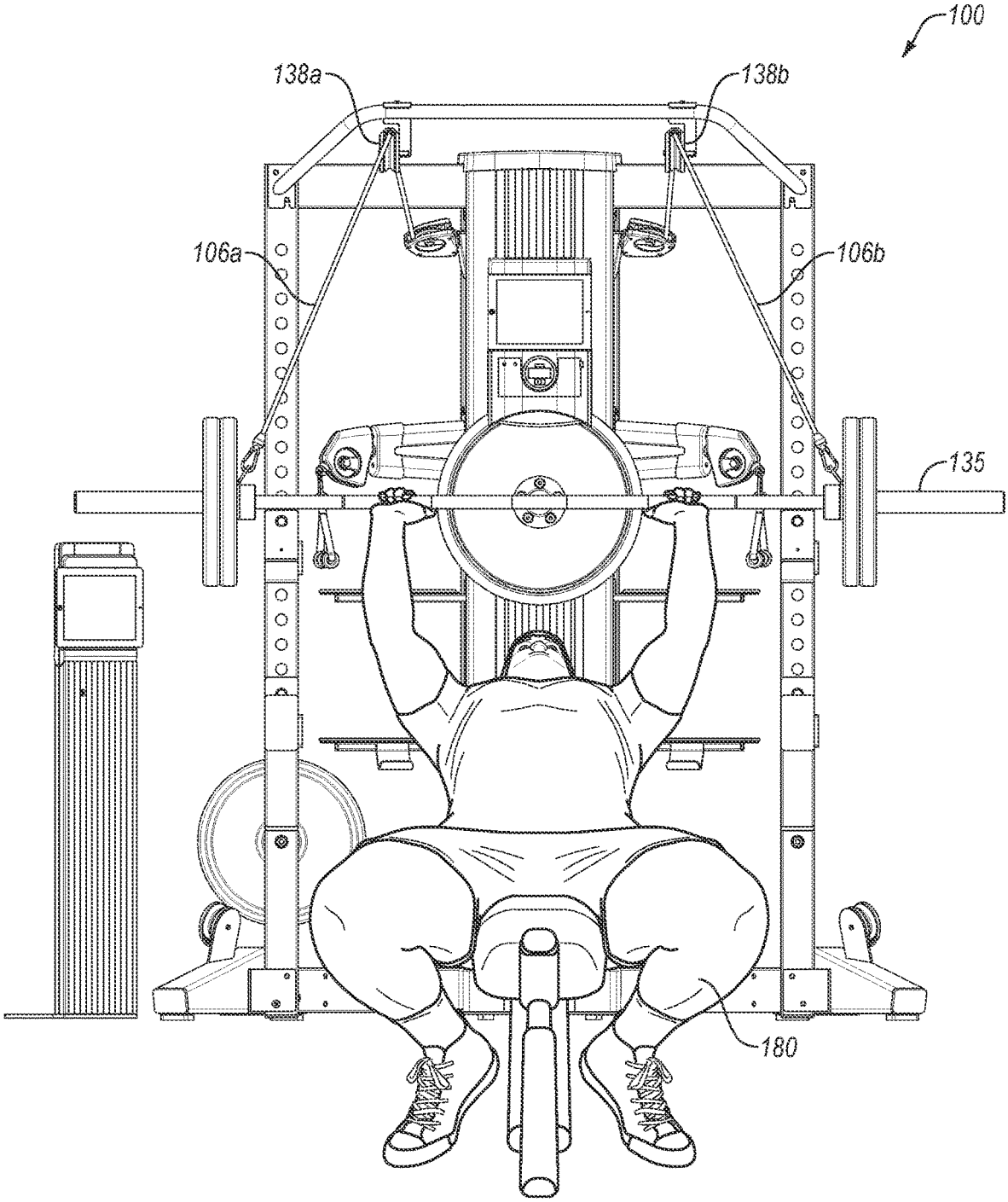
Figure 3C:
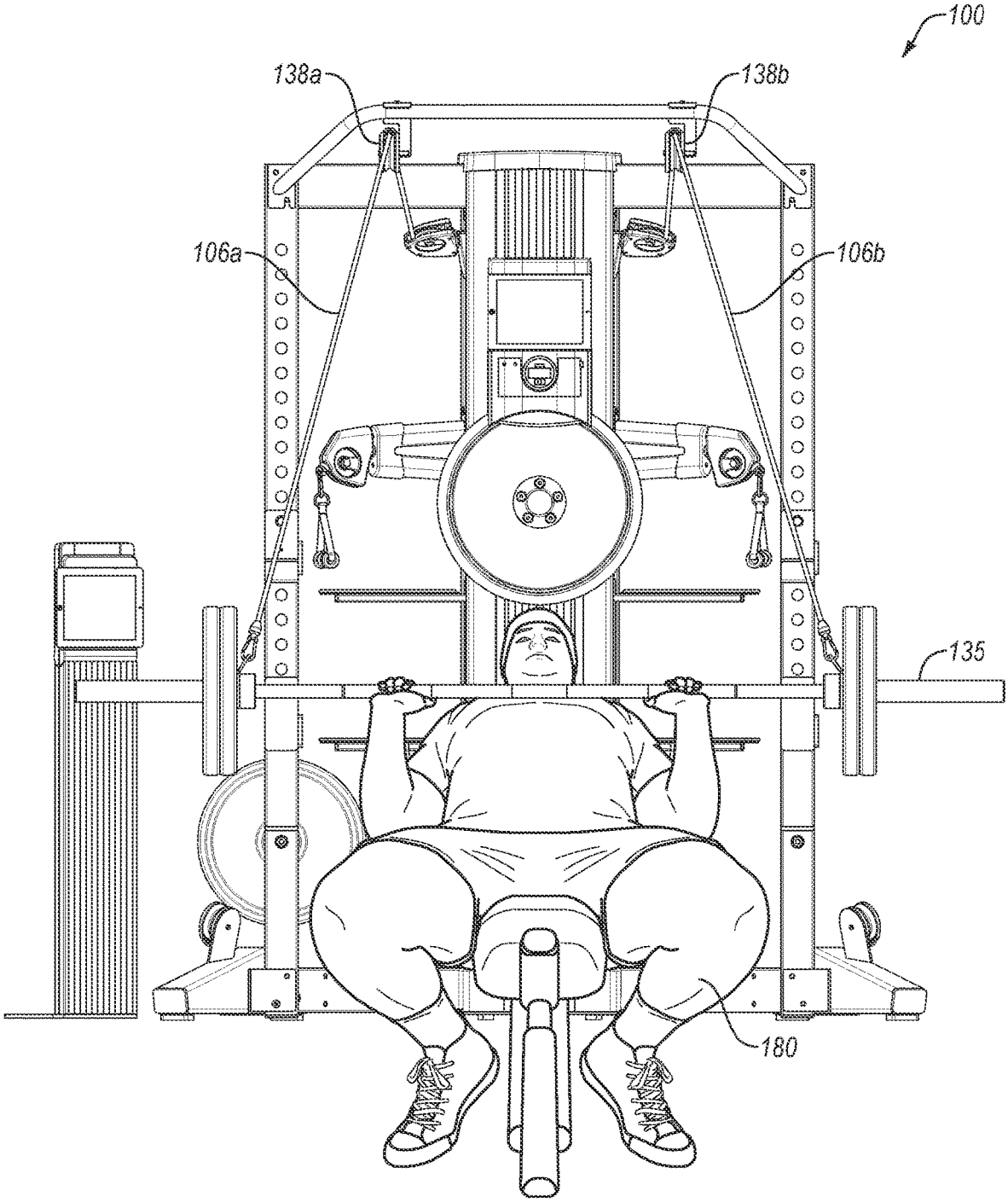

FIGS. 3A-3C illustrate a user preparing to lift, lifting, and lowering a barbell using the example cable and power rack exercise machine 100 of FIGS. 1A-1E. As illustrated in FIGS. 3A-3C, the left and right upper pulleys 138*a* and 138*b* may be configured to selectively receive the pull cables 106*a* and 106*b*, respectively, after the handles 120*a* and 120*b* have been detached therefrom, in order to enable the pull cables 106*a* and 106*b* to be selectively attached to the barbell 135. This selective attachment of the pull cables 106*a* and 106*b* to the barbell 135 in this manner may enable the left and right tensioner springs 125*a* and 125*b* (see FIG. 1D) to assist the user 180 in lifting the barbell 135. For example, the left and right tensioner springs 125*a* and 125*b* may each include a spring constant of a particular value of pounds of force per inch (lbf/in). The spring constant may be configured to provide a particular amount of force assisting the user 180 when lifting the barbell 135 as disclosed in FIGS. 3A-3C. For example, the left and right tensioner springs 125*a* and 125*b* may be configured to provide an assisting force between 3-5 pounds, between 2-8 pounds, between 1-11 pounds, or between 2-20 pounds assisting the user 180 when lifting the barbell 135 as disclosed in FIGS. 3A-3C. This force assisting the user 180 may change the more the left and right tensioner springs 125*a* and 125*b* are stretched, following a load versus deflection curve. As disclosed in FIGS. 3A-3C, the force assisting the user 180 may increase as the user 180 lowers the barbell 135 (because the left and right tensioner springs 125*a* and 125*b* become increasingly stretched), and may decrease as the user 180 lifts the barbell 135 (because the left and right tensioner springs 125*a* and 125*b* become decreasingly stretched). In this manner, the left and right tensioner springs 125*a* and 125*b* may assist the user 180 most when the barbell 135 is at its lowest point and when the user 180 may desire assistance most due to the user 180 having the least amount of leverage.

INDUSTRIAL APPLICABILITY

In general, the example exercise machine disclosed herein may combine features of a cable machine and features of a power rack to yield a superior exercise machine where a user can perform cable workouts, free weight workouts, or combined workouts. In a combined workout, the cables of the exercise machine may be attached to a barbell to assist the user in performing a workout with the barbell by either making the barbell easier to lift or harder to lift, depending on the desired effect. The exercise machine may also include certain bottom-out features that prevent the cables from being fully extended in order to maintain the effective assistance of the cables, while pulling on the cables alone, or when using the cables while attached to the barbell.

The exercise machine disclosed herein may be employed to perform a high-intensity lifting workout, a cardio building workout, or a high intensity interval training (HIIT) workout, or some combination thereof. The exercise machine may be employed at a gym or in a home setting.

Various modifications to the example exercise machine disclosed above will now be disclosed.

Although the example exercise machine disclosed herein includes six pull cables, in some embodiments as few as two pull cables or more than six pull cables may be included. Further, pull cables may be positioned at positions other than those illustrated in the drawings.

Further, although tensioner springs are disclosed herein, in some embodiments the tensioner springs may be replaced with any other mechanism that is configured to reduce slack in pull cables, such as elastic cords, counterweights, or other types of springs. In these embodiments, the other mechanism that is configured to reduce slack in pull cables may continue to function as described above in connection with the barbell to either make lifting the barbell easier to lift or harder to lift, depending on the desired effect.

Also, although the resistance mechanism disclosed herein includes a flywheel and one or more magnets arranged to selectively resist rotation of the flywheel, in some embodiments the resistance mechanism may instead include another type of brake (with or without a flywheel), a motor, weights, or other structure(s) capable of providing resistance to pull cables linked thereto. In the case of a motor, the resistance mechanism may double as both a resistance mechanism as well as a mechanism that affirmatively pulls on the pull cables with a set amount of force. In this case, the motor may be attached to a barbell, and may be controlled by a console or other controller to pull on the barbell pull cable(s) upon a command (e.g., a verbal command) of a user, or upon a torque sensor, motion sensor, or other sensor noticing that the user is unable to lift the barbell without some assistance, thus functioning as a virtual spotter to assist the user in lifting the barbell and thus replacing a human spotter. Further, where the resistance mechanism is used to make lifting the barbell harder, the console may be configured to control the resistance mechanism such that the resistance on the barbell gets progressively harder, or progressively easier, to enhance the lifting of the barbell. For example, the resistance mechanism can be controlled to assist a user in lifting the barbell during the final few reps in a set. Alternatively or additionally, the resistance mechanism can be controlled to provide progressive resistance by providing a digital chain that increases the resistance on the barbell with each lift.

Further, although the bottom-out mechanism disclosed herein includes sensors positioned on left and right legs of the exercise machine, in some embodiments the bottom-out mechanism sensors may be positioned anywhere else on the exercise machine, or may be positioned on a separate device in communication with the console of the exercise machine. Further, although the bottom-out mechanism disclosed herein includes sensors, in some embodiments the sensors may be replaced with visual indicators on the pull cables themselves, such as where a pull cable transitions from one color to another, or has another visual marking, when the cable is within a threshold (e.g., within 2 feet) of being fully extended. Also, the bottom-out mechanism disclosed herein may further include one or more brakes configured, in response to a sensor triggering, to engage the pull cables to prevent the pull cables from being extended past some threshold of being fully extended. This brake may prevent a user from pulling a pull cable too far away from the exercise machine.

Also, although the console disclosed herein is discussed as having functionality capable of adjusting the resistance on the resistance mechanism, in some embodiments the console may further be configured with computer functionality to receive input from the user and provide output to the user, and/or configured to control the exercise machine. For example, the console may be employed in connection with the resistance mechanism discussed above in order to allow the user to manually or programmatically alter the amount of resistance that the resistance mechanism applies during the course of a workout on the exercise machine. The console may be configured to communicate over a network (e.g. a Bluetooth network, a WiFi network, or the Internet) with other similar exercise machines, with servers, with computing devices of personal trainers, and with sensors such as heart rate and respiration sensors, etc. Further, the console may be capable of downloading and uploading data in order to, for example, download and upload workouts, data gathered at the exercise machine, and data gathered at other exercise machines, etc. The console may enable a user of the exercise machine to compete with a user of another similar or dissimilar exercise machine, that is local to or remote from the user, with the competing users competing in real-time or at different times. Further, the console may be configured to track the amount of resistance provided by the resistance mechanism, and the number or rotations of the flywheel, during a workout in order to compute the number of calories burned, the amount of energy expended, the amount of work performed, or any other metric or statistic desired by the user. Further, the console may be configured to track the number of cable pulls, the number of barbell lifts and weight lifted, the number of dumbbell lifts and weight lifted, and any other exercise performed in connection with the exercise machine in order to track the number of calories burned, the amount of energy expended, the amount of work performed, or any other metric or statistic desired by the user during a workout using the exercise machine. Further, all data tracked or downloaded by the console may be presented to the user on a display of the console or on a display of another device, such as a tablet or smartphone that is connected via Bluetooth with the console. Further, the console, or another device connected to the console, may be configured to guide a user through a workout using the exercise machine. This guidance may be audible guidance, visual guidance, or some combination of the two, including guidance that employs video depicting exactly what a user should do to follow the workout. In this manner, a user can have the benefit of a trainer without a human trainer present. Further, this guidance may include using lasers or other projected visual indicators to assist a user in performing a workout properly. For example, lasers may be employed to show a user where to place their feet, to show a user how far to pull a pull cable, to show a user how to properly position their hips, knees, joints, head, shoulders, or any other body part to properly perform a cable or free weight exercise. Further, the console may be configured to function as a real-time live video interface to a human trainer who can guide a user through a workout on the exercise machine without the human trainer being present. Further, live or pre-recorded workout sessions may be displayed on the console, or another connected device, such as live studio sessions, powerlifting sessions, full-body sculpting sessions, and world-class coaching sessions. Further, the console may be configured such that a remote trainer, a live video feed, or a pre-recorded video feed or workout can control the resistance or other parameters of the exercise machine. Also, the console may be configured with multiple user profiles to store preferences and other settings for more than one user.

In addition to the accessories disclosed above, in some embodiments the exercise machine may further include other accessories, such as dumbbells, kettlebells, a barbell holder attached to the frame or the power rack for storage of the barbell, an adjustable weight bench for performing weight lifting exercise while lying down, sitting, or somewhere in between lying down or sitting, and a rower attachment that may be connected to one of the pull cables to allow the exercise machine to be used as a rowing machine by a user.

Additionally or alternatively, any of the example components disclosed herein in connection with the exercise machine may be moved from generally mirrored left-and-right positions to other positions, such as non-mirrored positions or center positions. For example, instead of left and right pulleys, a single center pulley may be employed in some situations. In another example, more than two pulleys may function similarly to the left and right pulleys disclosed in the drawings. Therefore, the terms "left" and "right" as disclosed herein are for convenience only and are not intended to dictate generally mirrored left-and-right positions of components.

In accordance with common practice, the various features illustrated in the drawings may not be drawn to scale. The illustrations presented in the present disclosure are not meant to be actual views of any particular apparatus (e.g., device, system, etc.) or method, but are merely example representations that are employed to describe various embodiments of the disclosure. Accordingly, the dimensions of the various features may be arbitrarily expanded or reduced for clarity. In addition, some of the drawings may be simplified for clarity. Thus, the drawings may not depict all of the components of a given apparatus (e.g., device) or all operations of a particular method.

Terms used herein and especially in the appended claims (e.g., bodies of the appended claims) are generally intended as "open" terms (e.g., the term "including" should be interpreted as "including, but not limited to," the term "having" should be interpreted as "having at least," the term "includes" should be interpreted as "includes, but is not limited to," etc.).

Additionally, if a specific number of an introduced claim recitation is intended, such an intent will be explicitly recited in the claim, and in the absence of such recitation no such intent is present. For example, as an aid to understanding, the following appended claims may contain usage of the introductory phrases "at least one" and "one or more" to introduce claim recitations. However, the use of such phrases should not be construed to imply that the introduction of a claim recitation by the indefinite articles "a" or "an" limits any particular claim containing such introduced claim recitation to embodiments containing only one such recitation, even when the same claim includes the introductory phrases "one or more" or "at least one" and indefinite articles such as "a" or "an" (e.g., "a" and/or "an" should be interpreted to mean "at least one" or "one or more"); the same holds true for the use of definite articles used to introduce claim recitations.

In addition, even if a specific number of an introduced claim recitation is explicitly recited, it is understood that such recitation should be interpreted to mean at least the recited number (e.g., the bare recitation of "two recitations," without other modifiers, means at least two recitations, or two or more recitations). Furthermore, in those instances where a convention analogous to "at least one of A, B, and C, etc." or "one or more of A, B, and C, etc." is used, in general such a construction is intended to include A alone, B alone, C alone, A and B together, A and C together, B and C together, or A, B, and C together, etc. For example, the use of the term "and/or" is intended to be construed in this manner.

Further, any disjunctive word or phrase presenting two or more alternative terms, whether in the summary, detailed description, claims, or drawings, should be understood to contemplate the possibilities of including one of the terms, either of the terms, or both terms. For example, the phrase "A or B" should be understood to include the possibilities of "A" or "B" or "A and B."

Additionally, the use of the terms "first," "second," "third," etc., are not necessarily used herein to connote a specific order or number of elements. Generally, the terms "first," "second," "third," etc., are used to distinguish between different elements as generic identifiers. Absence a showing that the terms "first," "second," "third," etc., connote a specific order, these terms should not be understood to connote a specific order. Furthermore, absence a showing that the terms first," "second," "third," etc., connote a specific number of elements, these terms should not be understood to connote a specific number of elements. For example, a first widget may be described as having a first side and a second widget may be described as having a second side. The use of the term "second side" with respect to the second widget may be to distinguish such side of the second widget from the "first side" of the first widget and not to connote that the second widget has two sides.

The foregoing description, for purpose of explanation, has been described with reference to specific embodiments. However, the illustrative discussions above are not intended to be exhaustive or to limit the invention as claimed to the precise forms disclosed. Many modifications and variations are possible in view of the above teachings. The embodiments were chosen and described to explain practical applications, to thereby enable others skilled in the art to utilize the invention as claimed and various embodiments with various modifications as may be suited to the particular use contemplated.

A. An exercise machine comprising:

a frame;

a pull cable supported by the frame; and a power rack attached to the frame, the power rack including:

a first upright post configured to have a first barbell holder attached thereto; and a second upright post configured to have a second barbell holder attached thereto.

B. The exercise machine of claim A, further comprising:

a tensioner spring configured to reduce slack in the pull cable;

a first pulley configured to selectively receive the pull cable to enable the pull cable to be selectively attached to a barbell to enable the tensioner spring to assist a user in lifting the barbell, wherein the first tensioner spring is configured to provide between 3-5 pounds, between 2-8 pounds, between 1-11 pounds, or between 2-20 pounds of force assisting the user in lifting the barbell.

C. The exercise machine of claim A or B, further comprising:

a second pulley configured to selectively receive the pull cable to enable the pull cable to be selectively attached to a barbell to enable the tensioner spring to hinder a user in lifting the barbell, wherein the first tensioner spring is configured to provide between 3-5 pounds, between 2-8 pounds, between 1-11 pounds, or between 2-20 pounds of force hindering the user in lifting the barbell.

D. The exercise machine of claim C, wherein:

the exercise machine further comprises a resistance mechanism supported by the frame and linked to the pull cable;

the resistance mechanism is configured to be selectively set at one of multiple resistance levels; and the second pulley enables the resistance mechanism to hinder the user in lifting the barbell in proportion to the set resistance level of the resistance mechanism.

E. The exercise machine of claim D, wherein the resistance mechanism includes:

a flywheel; and one or more magnets arranged to selectively resist rotation of the flywheel.

F. The exercise machine of claim D, wherein the resistance mechanism includes a motor.

G. The exercise machine of claim A, further comprising:

a motor supported by the frame and linked to the pull cable;

a pulley configured to selectively receive the pull cable to enable the pull cable to be selectively attached to a barbell to enable the motor to assist a user in lifting the barbell.

H. The exercise machine of one of claims A-G, wherein the power rack further includes a pull-up bar supported by the first upright post and by the second upright post.

I. The exercise machine of one of claims A-H, wherein the power rack further includes:

a first weight plate holder supported by the first upright post; and a second weight plate holder supported by the second upright post.

J. The exercise machine of one of claims A-I, wherein the first barbell holder and the second barbell holder are configured as spotter arms to prevent a barbell from falling on a user if the user is unable to continue lifting the barbell.

K. The exercise machine of one of claims A-J, further comprising one or more dumbbell racks supported by the frame and each configured to hold a dumbbell.

L. The exercise machine of one of claims A-K, further comprising a barbell retention mechanism including:

a tube attached to the frame and configured to receive one end of the barbell; and a strap attached to the frame and configured to wrap around the other end of the barbell to keep the other end of the barbell positioned against the frame.

M. An exercise machine comprising:

a frame;

a pull cable supported by the frame; and a bottom-out mechanism configured to prevent the pull cable from being fully extended.

N. The exercise machine of claim M, wherein the bottom-out mechanism comprises:

a visual indicator on the pull cable.

O. The exercise machine of claim M, wherein the bottom-out mechanism comprises a sensor configured to trigger when one or more of:

the first pull cable and/or the second pull cable has been extended to within a threshold of being fully extended;

a user has moved past a threshold distance from the exercise machine; or a barbell has moved past a threshold distance from the exercise machine.

P. The exercise machine of claim O15, wherein the bottom-out mechanism further comprises:

an alarm configured, in response to the sensor triggering, to alert the user of a danger of the first pull cable and/or the second pull cable being fully extended.

Q. The exercise machine of claim O or P, wherein the bottom-out mechanism further comprises:

one or more brakes configured, in response to the sensor triggering, to engage the first pull cable and/or the second pull cable to prevent the first pull cable and/or the second pull cable from being fully extended.

R. The exercise machine of one of claims O-Q, wherein the sensor comprises one or more of:

an optical sensor;

a magnetic sensor;

a camera sensor; or an infrared sensor.

S. The exercise machine of one of claims O-R, wherein:

the exercise machine further comprises a power rack attached to the frame, the power rack configured to have a first barbell holder and a second barbell holder attached thereto;

the exercise machine further comprises a tensioner spring configured to reduce slack in the pull cable;

the exercise machine further comprises a pulley configured to selectively receive the pull cable to enable the pull cable to be selectively attached to a barbell to enable the tensioner spring to assist a user in lifting the barbell;

the exercise machine further comprises a second pulley configured to selectively receive the pull cable to enable the pull cable to be selectively attached to the barbell to enable the second tensioner spring to hinder the user in lifting the barbell; and the bottom-out mechanism is further configured to prevent the pull cable from being fully extended to avoid a user of the barbell, with the pull cable selectively attached thereto, from being prevented from moving a muscle group through a full range of motion while lifting the barbell.

T. An exercise machine comprising:

a frame;

a resistance mechanism supported by the frame;

a first pull cable and a second pull cable supported by the frame and linked to the resistance mechanism; and a power rack attached to the frame, the power rack including:

a first upright post configured to have a first barbell holder adjustably attached thereto such that the first barbell holder may be adjusted in various positions between a first highest position and a first lowest position on the first upright post; and a second upright post configured to have a second barbell holder adjustably attached thereto such that the second barbell holder may be adjusted in various positions between a second highest position and a second lowest position on the second upright post.

U. The exercise machine of claim T, further comprising:

a first tensioner spring configured to reduce slack in the first pull cable; and a second tensioner spring configured to reduce slack in the second pull cable.

V. The exercise machine of claim U, further comprising:

a first pulley configured to selectively receive the first pull cable to enable the first pull cable to be selectively attached to a barbell to enable the first tensioner spring to assist a user in lifting the barbell, wherein the first tensioner spring is configured to provide between 3-5 pounds, between 2-8 pounds, between 1-11 pounds, or between 2-20 pounds of force assisting the user in lifting the barbell; and a second pulley configured to selectively receive the second pull cable to enable the second pull cable to be selectively attached to the barbell to enable the second tensioner spring to assist the user in lifting the barbell, wherein the second tensioner spring is configured to provide between 3-5 pounds, between 2-8 pounds, between 1-11 pounds, or between 2-20 pounds of force assisting the user in lifting the barbell.

W. The exercise machine of claim U, further comprising:

a first pulley configured to selectively receive the first pull cable to enable the first pull cable to be selectively attached to a barbell to enable the first tensioner spring to hinder a user in lifting the barbell, wherein the first tensioner spring is configured to provide between 3-5 pounds, between 2-8 pounds, between 1-11 pounds, or between 2-20 pounds of force hindering the user in lifting the barbell; and a second pulley configured to selectively receive the second pull cable to enable the second pull cable to be selectively attached to the barbell to enable the second tensioner spring to hinder the user in lifting the barbell, wherein the second tensioner spring is configured to provide between 3-5 pounds, between 2-8 pounds, between 1-11 pounds, or between 2-20 pounds of force hindering the user in lifting the barbell.

X. The exercise machine of claim W, wherein:

the resistance mechanism is configured to be selectively set at one of multiple resistance levels; and the first pulley and the second pulley enable the resistance mechanism to hinder the user in lifting the barbell in proportion to the set resistance level of the resistance mechanism.

Y. The exercise machine of one of claims T-X, wherein the resistance mechanism includes:

a flywheel; and one or more magnets arranged to selectively resist rotation of the flywheel.

Z. The exercise machine of one of claims T-X, wherein the resistance mechanism includes a motor.

AA. The exercise machine of one of claims T-Z, further comprising:

a motor supported by the frame and linked to the first pull cable and to the second pull cable;

a first pulley configured to selectively receive the first pull cable to enable the first pull cable to be selectively attached to a barbell to enable the motor to assist a user in lifting the barbell; and a second pulley configured to selectively receive the second pull cable to enable the second pull cable to be selectively attached to the barbell to enable the motor to assist the user in lifting the barbell.

BB. The exercise machine of one of claims T-AA, wherein the power rack further includes a pull-up bar supported by the first upright post and by the second upright post.

CC. The exercise machine of one of claims T-BB, wherein the power rack further includes:

a first weight plate holder supported by the first upright post; and a second weight plate holder supported by the second upright post.

DD. The exercise machine of one of claims T-CC, wherein the first barbell holder and the second barbell holder are configured as spotter arms to prevent a barbell from falling on a user if the user is unable to continue lifting the barbell.

EE. The exercise machine of one of claims T-DD, further comprising one or more dumbbell racks supported by the frame and each configured to hold a dumbbell.

FF. The exercise machine of one of claims T-EE, further comprising a barbell retention mechanism including:

a tube attached to the frame and configured to receive one end of the barbell; and a strap attached to the frame and configured to wrap around the other end of the barbell to keep the other end of the barbell positioned against the frame.

GG. An exercise machine comprising:

a frame;

a resistance mechanism supported by the frame;

a first pull cable and a second pull cable supported by the frame and linked to the resistance mechanism; and a bottom-out mechanism configured to prevent the first pull cable and the second pull cable from being fully extended.

HH. The exercise machine of claim GG, wherein the bottom-out mechanism comprises:

a first visual indicator on the first pull cable; and a second visual indicator on the second pull cable.

II. The exercise machine of claim GG, wherein the bottom-out mechanism comprises a sensor configured to trigger when one or more of:

the first pull cable and/or the second pull cable has been extended to within a threshold of being fully extended;

a user has moved past a threshold distance from the exercise machine; or a barbell has moved past a threshold distance from the exercise machine.

JJ. The exercise machine of claim II, wherein the bottom-out mechanism further comprises:

an alarm configured, in response to the sensor triggering, to alert the user of a danger of the first pull cable and/or the second pull cable being fully extended.

KK. The exercise machine of claims II or JJ, wherein the bottom-out mechanism further comprises:

one or more brakes configured, in response to the sensor triggering, to engage the first pull cable and/or the second pull cable to prevent the first pull cable and/or the second pull cable from being fully extended.

LL. The exercise machine of claims II-KK, wherein the sensor comprises one or more of:

an optical sensor;

a magnetic sensor;

a camera sensor; or an infrared sensor.

MM. The exercise machine of one or claims GG-LL, wherein:

the exercise machine further comprises a power rack attached to the frame, the power rack configured to have a first barbell holder and a second barbell holder adjustably attached thereto;

the exercise machine further comprises a first tensioner spring configured to reduce slack in the first pull cable;

the exercise machine further comprises a second tensioner spring configured to reduce slack in the second pull cable;

the exercise machine further comprises a first pulley configured to selectively receive the first pull cable to enable the first pull cable to be selectively attached to a barbell to enable the first tensioner spring to assist a user in lifting the barbell;

the exercise machine further comprises a second pulley configured to selectively receive the second pull cable to enable the second pull cable to be selectively attached to the barbell to enable the second tensioner spring to assist the user in lifting the barbell; and the bottom-out mechanism is further configured to prevent the first pull cable and the second pull cable from being fully extended to avoid a user of the barbell, with the first pull cable and the second pull cable selectively attached thereto, from being prevented from moving a muscle group through a full range of motion while lifting the barbell.

The invention claimed is:

1. An exercise machine comprising:

a frame;

a resistance mechanism supported by the frame;

a first pull cable and a second pull cable supported by the frame and linked to the resistance mechanism; and a power rack attached to the frame, the power rack including:

a first upright post configured to have a first barbell holder adjustably attached thereto such that the first barbell holder is configured to be adjusted in various positions between a first highest position and a first lowest position on the first upright post; and a second upright post configured to have a second barbell holder adjustably attached thereto such that the second barbell holder is configured to be adjusted in various positions between a second highest position and a second lowest position on the second upright post;

a first tensioner spring configured to reduce slack in the first pull cable;

a second tensioner spring configured to reduce slack in the second pull cable;

a first handle selectively attachable to the first pull cable and a second handle selectively attachable to the second pull cable for the performance of cable workouts when the first and second handles are respectively attached to the first and second pull cables;

a first pulley configured to selectively receive the first pull cable to enable the first pull cable to be selectively attached to a barbell to enable the first tensioner spring to assist or hinder a user in lifting the barbell in a combined cable and free weight workout, the first pull cable decoupled from the first pulley for cable workouts; and a second pulley configured to selectively receive the second pull cable to enable the second pull cable to be selectively attached to the barbell to enable the second tensioner spring to assist or hinder the user in lifting the barbell in the combined cable and free weight workout, the second pull cable decoupled from the second pulley for cable workouts.

2. The exercise machine of claim 1, wherein:

the first pulley is configured to selectively receive the first pull cable to enable the first pull cable to be selectively attached to the barbell to enable the first tensioner spring to hinder the user in lifting the barbell, wherein the first tensioner spring is configured to provide between 3-5 pounds, between 2-8 pounds, between 1-11 pounds, or between 2-20 pounds of force hindering the user in lifting the barbell; and the second pulley is configured to selectively receive the second pull cable to enable the second pull cable to be selectively attached to the barbell to enable the second tensioner spring to hinder the user in lifting the barbell, wherein the second tensioner spring is configured to provide between 3-5 pounds, between 2-8 pounds, between 1-11 pounds, or between 2-20 pounds of force hindering the user in lifting the barbell.

3. The exercise machine of claim 2, wherein:

the resistance mechanism is configured to be selectively set at one of multiple resistance levels; and the first pulley and the second pulley enable the resistance mechanism to hinder the user in lifting the barbell in proportion to the set resistance level of the resistance mechanism.

4. The exercise machine of claim 1, wherein:

the first pulley is configured to selectively receive the first pull cable to enable the first pull cable to be selectively attached to the barbell to enable the first tensioner spring to assist the user in lifting the barbell, wherein the first tensioner spring is configured to provide between 3-5 pounds, between 2-8 pounds, between 1-11 pounds, or between 2-20 pounds of force assisting the user in lifting the barbell; and the second pulley is configured to selectively receive the second pull cable to enable the second pull cable to be selectively attached to the barbell to enable the second tensioner spring to assist the user in lifting the barbell, wherein the second tensioner spring is configured to provide between 3-5 pounds, between 2-8 pounds, between 1-11 pounds, or between 2-20 pounds of force assisting the user in lifting the barbell.

5. The exercise machine of claim 1, wherein:

the resistance mechanism includes a motor;

the motor is configured to assist the user in lifting the barbell.

6. The exercise machine of claim 1, wherein the power rack further includes a pull-up bar supported by the first upright post and by the second upright post.

7. The exercise machine of claim 1, wherein the power rack further includes:

a first weight plate holder supported by the first upright post; and a second weight plate holder supported by the second upright post.

8. The exercise machine of claim 1, further comprising a first spotter arm adjustably attached to the first upright post and a second spotter arm adjustably attached to the second upright post, the first and second spotter arms configured to prevent the barbell from falling on the user if the user is unable to continue lifting the barbell.

9. The exercise machine of claim 1, further comprising one or more dumbbell racks supported by the frame and each configured to hold a dumbbell.

10. The exercise machine of claim 1, further comprising a barbell retention mechanism including:

a tube attached to the frame and configured to receive a first end of the barbell; and a strap attached to the frame and configured to wrap around a second end of the barbell to keep the second end of the barbell positioned against the frame.

11. An exercise machine comprising:

a frame;

a resistance mechanism supported by the frame;

a first pull cable and a second pull cable supported by the frame and linked to the resistance mechanism; and a power rack attached to the frame, the power rack including:

a first upright post configured to have a first barbell holder adjustably attached thereto such that the first barbell holder is configured to be adjusted in various positions between a first highest position and a first lowest position on the first upright post; and a second upright post configured to have a second barbell holder adjustably attached thereto such that the second barbell holder is configured to be adjusted in various positions between a second highest position and a second lowest position on the second upright post;

a first handle selectively attachable to the first pull cable and a second handle selectively attachable to the second pull cable for the performance of cable workouts when the first and second handles are respectively attached to the first and second pull cables;

a first pulley configured to selectively receive the first pull cable to enable the first pull cable to be selectively attached to a barbell to assist or hinder a user in lifting the barbell in a combined cable and free weight workout, the first pull cable decoupled from the first pulley for cable workouts; and a second pulley configured to selectively receive the second pull cable to enable the second pull cable to be selectively attached to the barbell to assist or hinder the user in lifting the barbell in the combined cable and free weight workout, the second pull cable decoupled from the second pulley for cable workouts.

12. The exercise machine of claim 11, further comprising:

a first tensioner spring configured to reduce slack in the first pull cable and to assist or hinder the user in lifting the barbell when the first pull cable is attached to the barbell; and a second tensioner spring configured to reduce slack in the second pull cable and to assist or hinder the user in lifting the barbell when the second pull cable is attached to the barbell.

13. The exercise machine of claim 11, wherein:

the resistance mechanism is configured to be selectively set at one of multiple resistance levels; and the first pulley and the second pulley enable the resistance mechanism to hinder the user in lifting the barbell in proportion to the set resistance level of the resistance mechanism.

14. The exercise machine of claim 11, wherein:

the resistance mechanism includes a motor;

the motor is configured to assist the user in lifting the barbell.

15. The exercise machine of claim 11, wherein the power rack further includes a pull-up bar supported by the first upright post and by the second upright post.

16. The exercise machine of claim 11, wherein the power rack further includes:

a first weight plate holder supported by the first upright post; and a second weight plate holder supported by the second upright post.

17. The exercise machine of claim 11, further comprising a first spotter arm adjustably attached to the first upright post and a second spotter arm adjustably attached to the second upright post, the first and second spotter arms configured to prevent the barbell from falling on the user if the user is unable to continue lifting the barbell.

18. The exercise machine of claim 11, further comprising one or more dumbbell racks supported by the frame and each configured to hold a dumbbell.

19. The exercise machine of claim 11, further comprising a barbell retention mechanism including:

a tube attached to the frame and configured to receive a first end of the barbell; and a strap attached to the frame and configured to wrap around a second end of the barbell to keep the second end of the barbell positioned against the frame.

20. The exercise machine of claim 11, further comprising a bottom-out mechanism configured to prevent the first pull cable and the second pull cable from being fully extended.

* * * * *